US010916112B2

(12) United States Patent
Xin et al.

(10) Patent No.: US 10,916,112 B2
(45) Date of Patent: Feb. 9, 2021

(54) MULTI-VOLTAGE POWER SUPPLY SYSTEM FOR MERCHANDISE SECURITY

(71) Applicant: Hangzhou Langhong Kechuang Technology Co., Ltd., Zhejiang (CN)

(72) Inventors: Hong Xin, Zhejiang (CN); Zhenhua Li, Zhejiang (CN)

(73) Assignee: Hangzhou Langhong Kechuang Technology Co., Ltd., Hangzhou (CN)

( * ) Notice: Subject to any disclaimer, the term of this patent is extended or adjusted under 35 U.S.C. 154(b) by 0 days.

(21) Appl. No.: 16/597,835

(22) Filed: Oct. 9, 2019

(65) Prior Publication Data

US 2020/0118406 A1 Apr. 16, 2020

(30) Foreign Application Priority Data

Oct. 11, 2018 (CN) ..... 2018 1 1183098
Oct. 11, 2018 (CN) ..... 2018 1 1183100
Oct. 11, 2018 (CN) ..... 2018 2 1648313
Oct. 11, 2018 (CN) ..... 2018 2 1648314

(51) Int. Cl.
*G08B 13/14* (2006.01)
*G08B 29/04* (2006.01)
*G08B 13/24* (2006.01)

(52) U.S. Cl.
CPC ..... *G08B 13/2402* (2013.01); *G08B 13/1409* (2013.01); *G08B 13/1454* (2013.01); *G08B 29/04* (2013.01)

(58) Field of Classification Search
None
See application file for complete search history.

(56) References Cited

U.S. PATENT DOCUMENTS 5,341,124 A * 8/1994 Leyden ..... G08B 13/1454 340/568.4
5,561,417 A * 10/1996 Rothbaum ..... G08B 13/1454 340/568.2
6,104,289 A * 8/2000 Rand ..... G08B 13/1454 340/568.1
6,836,214 B2 * 12/2004 Choi ..... G08B 13/1409 340/568.1
7,015,596 B2 * 3/2006 Pail ..... G08B 13/1454 307/28
7,209,038 B1 * 4/2007 Deconinck ..... G08B 13/1409 340/541

(Continued)

*Primary Examiner* — Steven Lim
*Assistant Examiner* — Muhammad Adnan

(57) ABSTRACT

The present invention provides a multi-voltage power supply system for merchandise security, including a sensor configured to be connected to a plurality of merchandise, respectively, and an alarm including at least one interface for connecting the sensor, wherein the alarm is configured to be able to receive power and a safety signal from the sensor; the sensor is configured to be connectable to a power adapter via a power interface and to power the connected merchandise and/or alarm. In the present invention, the sensor is connected to an external power adapter, and the external power adapter supplies power to the sensor, and then the sensor supplies power to other components in a merchandise or an security system, such as the alarm, thereby reducing the input ports of the external power source and enabling the display of the security system more concise.

8 Claims, 16 Drawing Sheets

(56) References Cited

U.S. PATENT DOCUMENTS 8,558,688 B2 * 10/2013 Henson ..... G06F 1/1626 340/539.1
8,698,618 B2 * 4/2014 Henson ..... G08B 13/1472 340/539.1
9,019,113 B2 * 4/2015 Groth ..... G01R 31/54 340/657
10,482,739 B2 * 11/2019 Grant ..... G08B 13/149
10,592,862 B1 * 3/2020 Strom ..... G08B 13/1445
10,614,683 B2 * 4/2020 Berglund ..... G08B 13/1445
2008/0168806 A1 * 7/2008 Belden ..... E05B 73/0005 70/57.1
2010/0188222 A1 * 7/2010 Irmscher ..... G08B 13/1445 340/568.2
2012/0182146 A1 * 7/2012 Berglund ..... G08B 13/1445 340/568.2
2012/0280810 A1 * 11/2012 Wheeler ..... G08B 13/1445 340/539.11
2013/0194096 A1 * 8/2013 Belden, Jr. ..... G08B 13/1463 340/568.4
2013/0268316 A1 * 10/2013 Moock ..... H04M 1/72569 705/7.29
2014/0111337 A1 * 4/2014 Taylor ..... G08B 13/1445 340/568.3
2014/0114708 A1 * 4/2014 Campbell ..... G06Q 30/0201 705/7.11
2014/0266724 A1 * 9/2014 Taylor ..... G08B 13/1445 340/568.3
2015/0235533 A1 * 8/2015 Grant ..... G08B 13/1445 340/568.2
2016/0351029 A1 * 12/2016 Fawcett ..... G08B 13/1481
2016/0371945 A1 * 12/2016 Ewen, III ..... G08B 13/1418
2017/0148288 A1 * 5/2017 Baker ..... G08B 13/2402
2017/0206757 A1 * 7/2017 Grant ..... E05B 73/0082
2017/0221327 A1 * 8/2017 Wu ..... G08B 25/10
2017/0330432 A1 * 11/2017 Richardson ..... G08B 13/1454
2018/0035827 A1 * 2/2018 Grant ..... G08B 13/1418
2018/0268672 A1 * 9/2018 Grant ..... G08B 13/1454

* cited by examiner

MULTI-VOLTAGE POWER SUPPLY SYSTEM FOR MERCHANDISE SECURITY

CROSS REFERENCE TO RELATED APPLICATIONS

The present application claims the benefit of Chinese Patent Application Nos. 201811183098.3, 201811183100.7, 201821648313.8, and 201821648314.2 filed on Oct. 11, 2018. All the above are hereby incorporated by reference.

FIELD OF THE INVENTION

The present invention relates to the technical field of merchandise security, and more particular to a multi-voltage power supply system that integrates alarming and power supply in the art. The present invention also relates to a plurality of apparatuses or components in the above system, such as an alarm, a sensor and the like.

BACKGROUND OF THE INVENTION

Merchandise security mainly refers to the behavior or measures of taking certain security measures on a merchandise placed on a container, a booth or a display bracket in a retail industry to prevent unauthorized removal of the merchandise during an exhibition or display process. Traditional merchandise security takes the form of machinery, for example, storing the merchandise in a locked container, or locking the merchandise on a merchandise shelf or on the booth, however, the merchandise on the booth needs to move within a certain range to provide a display object with a space for experiencing a function, however, if a purchaser has the purchase demand for the merchandise displayed on the shelf, the purchaser can take the merchandise directly from the shelf to a checkout counter for settlement, and the purchaser also needs to be allowed to take down the merchandise from the shelf, therefore, a merchandise burglar-proof device needs to take into account both an exhibition requirement and a display requirement, at the same time, in these two modes, it is necessary to take into account the respective security requirements of each mode. The principle of the merchandise security is to send an audible and visual alarm when the merchandise is in an unsafe state to prompt the staff in a sales place.

The current merchandise security is usually that the merchandise is connected or fixed on an security host, when the merchandise leaves the security host or is disconnected from the security host, the security host sends alarming, in this way, the merchandise and the security host need to be directly or indirectly connected with each other, so an security form is single, and the scope of application is narrow; in addition, the installation and connection relationship between the merchandise and the security host need to be sensed by a sensor, and a single-performance sensor has a low fault tolerance; further, the current merchandise security is usually required to supply power to the security host, an alarm, and the merchandise, respectively, in some cases, the security host and the merchandise can be combined to be powered, but the alarm shall still be powered independently.

SUMMARY OF THE INVENTION

The technical problem to be solved by the present invention is to provide a multi-voltage power supply system for merchandise security against the problems existing in the technical background.

The technical solution adopted by the present invention to solve the technical problem is as follows:

A multi-voltage power supply system for merchandise security includes:

a sensor configured to be connected to a plurality of merchandise, respectively, and to sense whether the merchandise to which the sensor is connected is in a safe state, and to send a safety signal when the connected merchandise is unauthorizedly removed and/or the sensor connection is disconnected and/or a power adapter is powered off;

an alarm including at least one interface for connecting the sensor, the alarm being configured to receive power supply of and a safety signal of the sensor;

the sensor is configured to be connectable to a power adapter via a power interface and to power the connected merchandise and/or the connected alarm.

Further, the alarm is configured to be able to supplying power without an external power source.

Further, the alarm is configured to have a voltage conversion module for converting various external voltages into an internal voltage suitable for the alarm.

Further, the alarm includes a plurality of interfaces, and the plurality of interfaces can cooperate with the plurality of sensors to realized different voltage inputs.

Further, the plurality of interfaces is connected to the voltage conversion circuit, respectively.

Further, the sensor includes an inductive device that can be directly or indirectly connected to a power interface for connecting a power adapter, and is configured to be able to supply power to the merchandise and/or the alarm;

The inductive device includes a first cable and a second cable, the first cable is directly or indirectly connected to the inductive device and the alarm, and the second cable is directly or indirectly connected to the inductive device and the merchandise;

The inductive device includes an inductive circuit configured to sense a charged state and/or a connection state of the merchandise.

Further, the inductive circuit includes a current inductive circuit and a connection inductive circuit.

Further, a connector is included that is configured to be connected directly or indirectly to the merchandise and is able to power the merchandise.

Further, the connection inductive circuit is configured to sense whether the connector is connected to the merchandise.

Further, the current inductive circuit is configured to sense whether the current between the merchandise and the power adapter is present.

The various technical aspects included in the present invention will be described in detail below.

As the first aspect of the present invention, the present invention provides a sensor for merchandise security and for connecting an external power adapter, the sensor includes an inductive device directly or indirectly connected to a power interface, wherein the power interface is configured to be connected to the power adapter configured to provide power to a merchandise.

The inductive device functions as connecting an external power adapter and the merchandise, and continuously providing the merchandise with the power from the external power adapter, and is considered as one condition that the merchandise is in a safe state, once the merchandise is powered off, the inductive device is considered as being that the merchandise may be in an unsafe state and a burglar-proof alarm may be required to be sent at this time.

A first cable is also included that is directly or indirectly connected to the inductive device, and a second cable is included that is directly or indirectly connected to the inductive device and the merchandise.

The first cable is configured to provide a connection between the inductive device and other apparatuses such as an alarm, one end of the first cable is connected to the inductive device, and the other end thereof is connected to other devices, thereby providing a medium for power transmission of the two apparatuses; the first cable and the inductive device can be directly and fixedly connected, or can be indirectly connected via an adapter or a connector, this connection can be always fixed or detachable, generally speaking, the first cable is connected to an input terminal of an external apparatus and to an output terminal of the inductive device.

The second cable is configured to provide a connection between the inductive device and the merchandise, one end of the second cable is connected to the inductive device, and the other end thereof is connected to the merchandise, thereby providing a medium for power transmission of the two apparatuses; the second cable and the inductive device can be directly and fixedly connected, or can be indirectly connected via the adapter or the connector, this connection can be always fixed or detachable, generally speaking, the second cable is connected to the output terminal of the inductive device and an input terminal of the merchandise, in some preferred aspects, the second cable is connected to and powers the merchandise via a charging interface.

The inductive device includes an inductive circuit configured to sense a charged state and/or a connection state of the merchandise. The charged state here refers to a state in which the merchandise is connected to and powered by the inductive device via the second cable, if the merchandise is in the charged state, the merchandise is considered to be safe, if the merchandise is in a non-charged state, a charging interface may be pulled out, it may be that the cable being charged is cut off, in either case, the merchandise may be considered to be in an unsafe state, in particular, if the charging interface of the merchandise is not authorized to be disconnected, then the merchandise may be considered as being possibly stolen or being in danger of being stolen. The connection state here refers to the physical connection state of the merchandise via the second cable, this connection state is an security measures for the merchandise implemented from a purely structured form, if the second cable is always connected to the merchandise in a structure, the merchandise does not break away from the second cable, the merchandise is considered to be safe, if the connection between the merchandise and the second cable is disconnected, for example, the second cable is pulled out of the merchandise, the merchandise may be considered to be the unsafe state, in particular, if the second cable is unauthorizedly pulled out, it is considered that the merchandise may be possibly stolen or in danger of being stolen.

The sensor is configured to send a safety signal when the merchandise is unauthorizedly removed and/or a sensor cable is cut and/or the power adapter is powered off, the safety signal refers to a signal that the merchandise is in a safe or unsafe state, the safety signal is configured to be sent to an alarm device and indicates that the alarm device is alerted, and the safety signal may come from the foregoing case that the cable is cut off or the power is off, or from the foregoing case that the merchandise is removed from a clamping device or leaves the clamping device, or from the foregoing case that the charging interface is pulled out or the charged state is suspended, the above cases may indicate that the merchandise is in the unsafe state, then, the sensor generates the safety signal correspondingly. In the field of the merchandise security, the sensor is a conventional technical means as one component of generating the safety signal, so the generation of the safety signal is a basic function of the sensor, and the improvement made by the present invention is not in the sensor itself.

Further, the inductive circuit includes a current inductive circuit and a connection inductive circuit, the inductive circuit functions as sensing whether a corresponding signal or a connection exists, the inductive circuit can be integrated in the inductive device to sense a current and the on/off of a physical connection. The current inductive circuit here can correspondingly sense whether there is power transmission from the inductive device to the merchandise in the second cable, for example, is there the current flowing from the inductive device to the merchandise? If yes, the merchandise is considered to be in the charged state, if no, the merchandise is considered to be in a state of disconnected charging, at this time, the merchandise may be unsafe. The connection inductive circuit here may correspondingly sense the structural connection relationship between the second cable and the merchandise, and for example, sense whether the structural connection of the second cable and the merchandise is present or undamaged.

Further, the connector is included that is configured to be connected directly or indirectly to the merchandise and is able to power the merchandise. The connector can perform the above-described function of connecting the merchandise, in some preferred solutions, the connector can be a physical form of the interface, in some preferred solutions, the connector can be one charging interface with a plug-in function. The connector can serve as a connection medium for the second cable and the merchandise, in some preferred solutions, the connector is arranged at one end of the second cable for a physical and electrical connection with the merchandise and is able to power the merchandise. Similarly, in some preferred arrangements, the connector can be connected directly to the merchandise, and in other preferred solutions, the connector can be indirectly connected to the merchandise via a transfer interface or other means.

Further, the connection inductive circuit is configured to sense whether the connector is connected to the merchandise. As described above, the connection inductive circuit senses the structural connection relationship between the second cable and the merchandise, then, when the second cable is connected to the merchandise via the connector, the connection inductive circuit is configured to sense whether the connection of the connector and the merchandise is undamaged.

Further, the current inductive circuit is configured to sense whether the current between the merchandise and the power adapter is present. In some preferred solutions, the current inductive circuit is configured to sense whether the merchandise has the power input thereto, the input power can be transmitted by the inductive device via the second cable, or can be transmitted by the power adapter via the inductive device and the second cable, or is transmitted by the power adapter via the second cable, or is directly transmitted by the power adapter, and in some preferred solutions, an inductive object of the current inductive circuit may be whether the merchandise is in the charged state, or whether there is the current input to the merchandise, and no matter where the current comes from, in other preferred solutions, if the second cable is configured to supply power to the merchandise, the current inductive circuit can be configured in the second cable to sense the on/off of the current between the second cable and the merchandise, in other preferred solutions, the current inductive circuit can be arranged in the inductive device for sensing whether the merchandise is in the charged state.

Further, the sensor is connected to the alarm, the alarm is configured to be connected to the inductive circuit for receiving the safety signal of the sensor. The sensor of the present invention can match with the alarm, and the sensor directly supplies power to the alarm, and the alarm does not need an external power supply.

As the second aspect of the present invention, the present invention may further include one connection device for connecting a merchandise, an external power source, and an alarm device, the connection device can also be configured to be accessed to the external power source to be shunted to supply power to the alarm and the merchandise respectively while being physically connected, in addition, the connection device can also function as a connection sensor, and the sensor can be arranged in the connection device or on a certain cable of the connection device, or is arranged at a connection terminal of the connection device and the cable, or is arranged at an external terminal of the cable, and the connection device can include:

a bottom surface having a flat surface and configured to be able to be attached to a support surface; wherein the support surface here may be a display surface or other supporting surface able to supporting the merchandise or a connecting structure able to supporting the merchandise, since the bottom surface is directly in contact with the supporting surface, and may be fixed on the support surface, the bottom surface serves as a contact surface with the support surface, and needs to be flat.

a first surface perpendicular to the bottom surface and having a first interface for connecting a first cable, wherein the first cable is directly or indirectly connected to the alarm;

a power interface is arranged under the first interface, and the power interface is configured to be connected to the power adapter;

a second surface located in the middle of the connection device and having a second interface for connecting the second cable; wherein the second cable is configured to be directly or indirectly connected to the merchandise;

The first surface and the second surface are opposite, further, since the first surface and the second surface are opposite, the exit directions of the first interface and the second respectively located thereon are reversed. The reason for setting two opposite interfaces is to ensure that the outgoing lines do not cross, which plays a certain role in wire trimming, and a layout is more concise and reasonable, which is convenient for the positioning during the display.

The first surface and the second surface are configured to connect the first interface and the second interface, respectively, of course, the positions of the first interface and the second interface are also interchangeable, the relative position relationship of the first interface and the second interface are to be protected by the present invention.

Further, the entire connection device is configured to be fixed to the support surface by the bottom adhesives or to the support surface by use of a screw, and the connection of the connection device to the support surface may be a detachable or fixed connection.

Further, the power interface is connected to the outside in the connection device or through a cable, and a power connection cable can be configured on the power interface, one end of the power connection can extend into the connection device, and the other end thereof can be connected to an external power adapter.

Further, the second cable includes a connector, the connector and the power adapter have the same interface, and the connector of the second cable can have the same interface as a power adapter of an OEM, therefore, when the second cable is connected to the merchandise, the second cable can be adapted to the merchandise corresponding to the power adapter of the OEM, in some cases, the connector of the second cable and the power adapter of the OEM can also be matched with different types of interfaces, as long as the connector of the second cable and the power adapter of the OEM are suitable for the access of the merchandise, for example, a standard 5V merchandise, the connector is a micro and other interfaces, and the power adapter is a large USB interface.

As the third aspect of the present invention, the present invention further provides an alarm that can be powered by the above sensor, including at least one interface configured to be connected to the sensor and to be able to receive an inductive signal of the sensor.

The sensor at least includes one interface for connecting a power adapter and being configured to be able to provide power to the alarm and the merchandise, the sensor can be connected to the external power adapter via the above interface to receive power therefrom and provide power for the alarm and the connected merchandise that requires security.

A voltage conversion module is configured to convert the voltage input by the sensor into a voltage required for the operation of the alarm; the voltage conversion module can be built in the alarm to provide a voltage conversion function for the alarm.

Since the sensor is able to provide power to the alarm, the alarm is configured to operate without the need of being connected to the power adapter.

The alarm is configured to send an alarm signal when the merchandise is unauthorizedly removed and/or a sensor cable is cut and/or the power adapter is powered off.

Further, a plurality of interfaces is included, and the plurality of interfaces can cooperate with a plurality of the sensors to realize a plurality of different voltage inputs, and the plurality of interfaces can be arranged on the alarm, and each interface can be connected to and receive power from the corresponding sensor, the power supply of the sensor is first connected to a voltage conversion circuit, is converted by the voltage conversion circuit and is used by the alarm.

Further, a voltage conversion module includes the voltage conversion circuit, and the plurality of interfaces are connected to the voltage conversion circuit, respectively, and the plurality of interfaces are equivalent to being connected in parallel to an input terminal of the voltage conversion circuit, that is, a multi-voltage connected to the alarm device can be connected to the alarm in parallel, and each voltage can independently supply power to the alarm and send an inductive signal.

Further, the voltage conversion module includes at least one receiving port configured to receive an external voltage from the sensor, and one receiving port may correspondingly receive an external voltage of one sensor, and when there are inputs of a plurality of sensors, a plurality of the receiving ports corresponding to the input of each sensor can be equipped, and the plurality of receiving ports can be arranged in parallel on the voltage conversion module.

Further, the voltage conversion module includes at least one output port configured to output an internal operating voltage to other modules within the alarm.

Further, the voltage conversion module includes the voltage conversion circuit configured to convert the external voltage to the internal operating voltage suitable for other modules within the alarm.

Further, the alarm is configured with an alarm module, and the alarm module may be an alarm hardware such as sound and light.

Further, the alarm device is configured with a detection module, and the detection module may be a current detection circuit or a signal detection circuit for detecting whether there is input by an inductive signal.

The beneficial effects of the present invention are as follows: (1) The present invention connects the sensor to the external power adapter, and the external power adapter supplies power to the sensor, and then the sensor supplies power to other components in the merchandise or an security system, such as an alarm, thereby reducing the input port of the external power and being able to make the display of the security system more concise.

(2) In this connection mode of the present invention, the alarm can be arranged below a display surface together with the external power source, or a position that other display objects can not pay attention to, and the merchandise for display and experience remains before a display object, the display effect and user experience are better.

(3) The present invention adopts dual induction methods of current induction and connection induction, which can be applied to all charging display merchandise (an electronic merchandise), and the reliability and accuracy of induction can be higher, which can effectively reduce missing alarms and false alarms and improve the safe level and accuracy level of the security system.

(4) The alarm of the present invention can allow the inputs of a plurality of voltages, each voltage can be derived from a different external power adapter, which is equivalent to an alarm able to simultaneously allow the inputs by the different merchandise of the plurality of voltages, centralized alarming is performed, the amount of electricity of the alarm itself can also be achieved by these input voltages.

DETAILED DESCRIPTION

Figure 1:
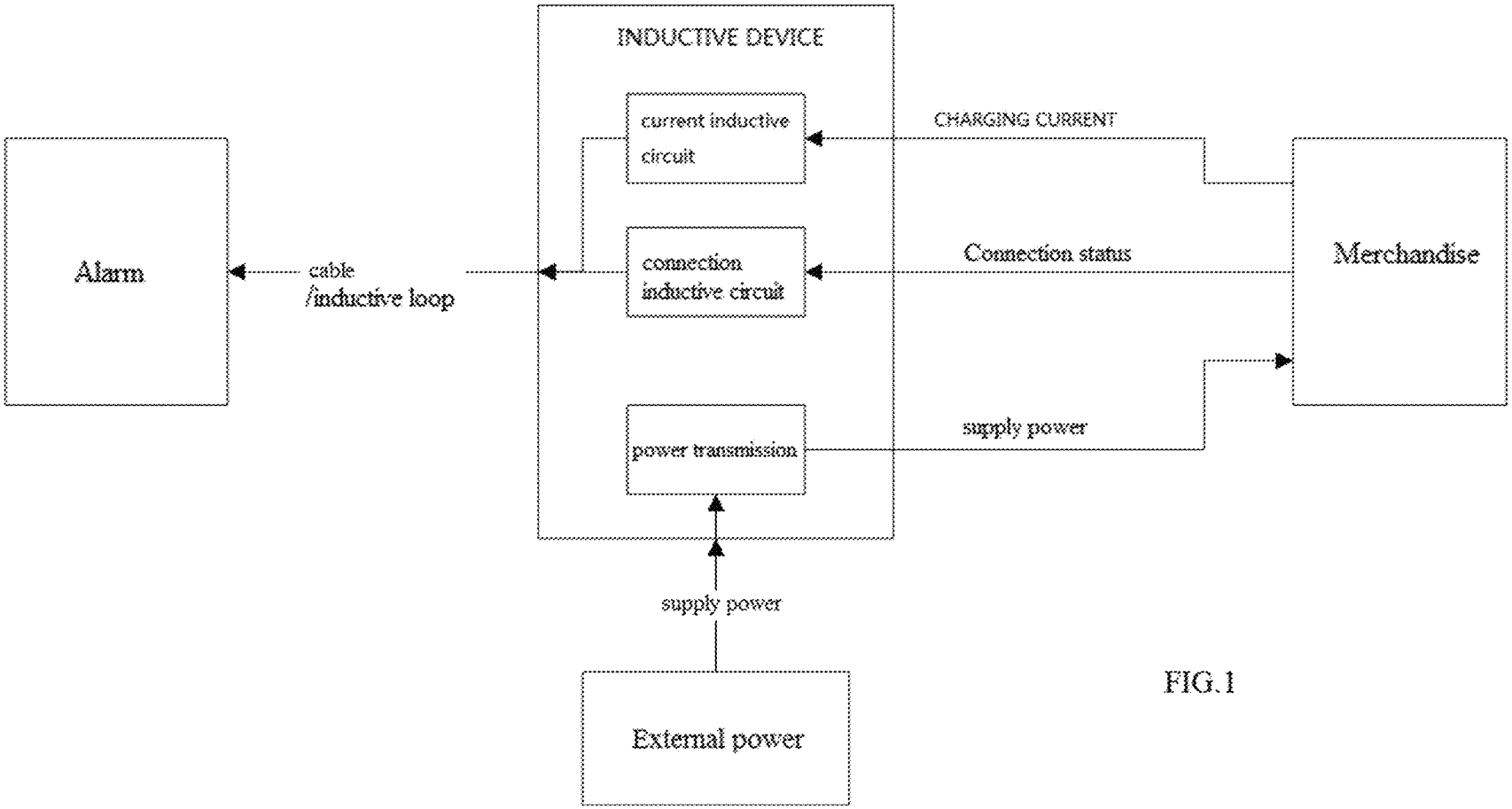
FIG. 1 is a schematic diagram of an inductive device of the present invention.

The specific embodiments of the present invention are further described in detail below with reference to the accompanying drawings, it should be noted that an embodiment is only specific to the present invention and should not be construed as limiting the present invention.

The technical terms involved in the present invention are first explained in conjunction with the embodiments, which is to enable those skilled in the art to more accurately understand the technical solutions of the present invention, the explanation of the terms does not limit the scope of protection of the present invention.

Merchandise Security

Merchandise security referred to in this application especially indicate some merchandise that need to be functionally displayed to a purchaser or a potential purchaser, such as electronic merchandise, some functions of these merchandise need to be understood by a user in the case of use. These merchandise usually have some human-computer interactive interfaces, an exhibitor can contact or display all or part of the functions of these merchandise in a certain range, so as to understand the performance of the merchandise, in the industry, sometimes, the merchandise with the functional display requirement is also called the merchandise with the experience requirement, that is, the exhibitor can operate and experience the displayed merchandise within the limited conditions and scope, therefore, the merchandise is directly contacted by an experiencer, the experiencer can use the merchandise within the scope limited by a seller or an owner of the merchandise, such as a sales location, but can not take the merchandise away from an experience location, since the ownership of the display belongs to the seller or the owner of the merchandise, therefore, it is needed to take security measures, these security measures do not limit the use of the experiencer, but only limit the experiencer to take the merchandise away from the location, in some cases, these security measures need to be considered as far as possible not to hinder the use of the experiencer, so that the experiencer can get better use and the experience the merchandise, which is different from the concept of security in mass-selling sales.

Sensor

The sensor is often used to sense a certain signal or to sense a certain state. In the present invention, the sensor is dedicated to the merchandise, that is, the above-mentioned display of the security of the merchandise, the sensor in the present invention may be a sensing line, It can be a device with an inductive component, or an inductive component integrated on a charging interface or an adapter or an security host. Its function is to be able to sense a signal and determine whether the displayed merchandise is in a safe state.

Safe State/Unsafe State

The "safe or unsafe" state as used in the present invention refers to the state in which the displayed merchandise is in, especially the state of the relationship between the displayed merchandise and an security device when the security device is arranged, in general, the state in which the merchandise is considered not to be stolen is called the safe state, the state in which the merchandise may be stolen is called the non-safe state, is the security measures undamaged? Is the merchandise under the protection of the security measures? if yes, then the merchandise is considered to be in the safe state, if no, then the merchandise is considered to be in the unsafe state, that is to say, this safe or unsafe state can be mentioned relative to security measures, for example, the security measures is that the displayed merchandise remains always connected to the charging interface, then the sensor detects whether the charging interface is always connected to the merchandise, if yes, the merchandise is in the safe state, if no, the merchandise is in the unsafe state; or, if the security measures is to keep the merchandise to be always in the charged state, the sensor detects whether the charging cable of the merchandise maintains power transmission, if yes, the merchandise is in the safe state, if no, the merchandise is in the unsafe state; or, if the security measure is that the merchandise is held by a clamping device, the sensor detects whether the merchandise is in a clamping space or whether the merchandise is in contact with the clamping device or mounted, if yes, the merchandise is in the safe state, if no, the merchandise is in the unsafe state; and so on.

Unauthorized Removal

In the present invention, non-authorization is mentioned relative to authorization, since there are two ways of locking and unlocking in the field of merchandise security, in the process of displaying the merchandise, the merchandise is usually in a locked state, in which state, the merchandise will not be stolen, but in addition to that the merchandise is stolen, the merchandise may be taken off an security device by a merchant actively, for example, when a merchandise has not been sold again, a corresponding exhibit will be removed, this involves the replacement of the merchandise, or when the exhibit has a quality problem and need to be repaired, the exhibit may also need to be removed from the security device, when the displayed merchandise are replaced or repaired, authorized staff (the merchant) will remove the merchandise from the security device, this removal is called as an authorized removal, otherwise, the removal is considered an unauthorized removal.

Cable

A cable is a connection and/or transmission concept in the present invention, in some cases, the cable can be a purely mechanical connection that connects two merchandise and, in some cases, the cable can provide power transmission (strong current) to establish a power connection for two sides connected by cable, one of the two sides can provide power to the other party, or both parties can have the power transmission, and in some cases, data transmission (including weak current) can be provided in the cable, providing power and data connection for both sides of the cable connection, one of which can provide power or transmit data signals to the other party, or both parties can have the power and the data signals transmitted to each other, in some cases, a power transmission line in the cable can be used as an inductive loop, that is, a judging factor for detecting whether the cable is turned on or off, for example, when there is the power transmission in the cable, the inductive loop can be considered to be unblocked, and the cable is in a normal connection state, at this time, if the cable is connected to the merchandise and an security host, the merchandise can be considered to be in the safe state, or when there is a signal transmission in the cable, the inductive loop can be considered to be unblocked and the cable is in the normal connection state, if the cable is connected to the merchandise and the security host, the merchandise can be considered to be in the safe state, in this case, the cable can have an inductive function, which is equivalent to functioning as part of the sensor, and the cable at this time can be used as part of the sensor.

Connector

For connecting components, a connector can have an inserting manner or an inserted manner when connecting the components, that is, the connector includes a plug and a socket, the connector can have a charging function, for example, in the form of the charging interface, or the connector can also be a purely structured connection, the connector can be connected to a cable or in a separate form, when the connector is connected to the cable, the connector can also be used as part of the inductive loop on the sensor.

Specific Embodiments

Figure 18:
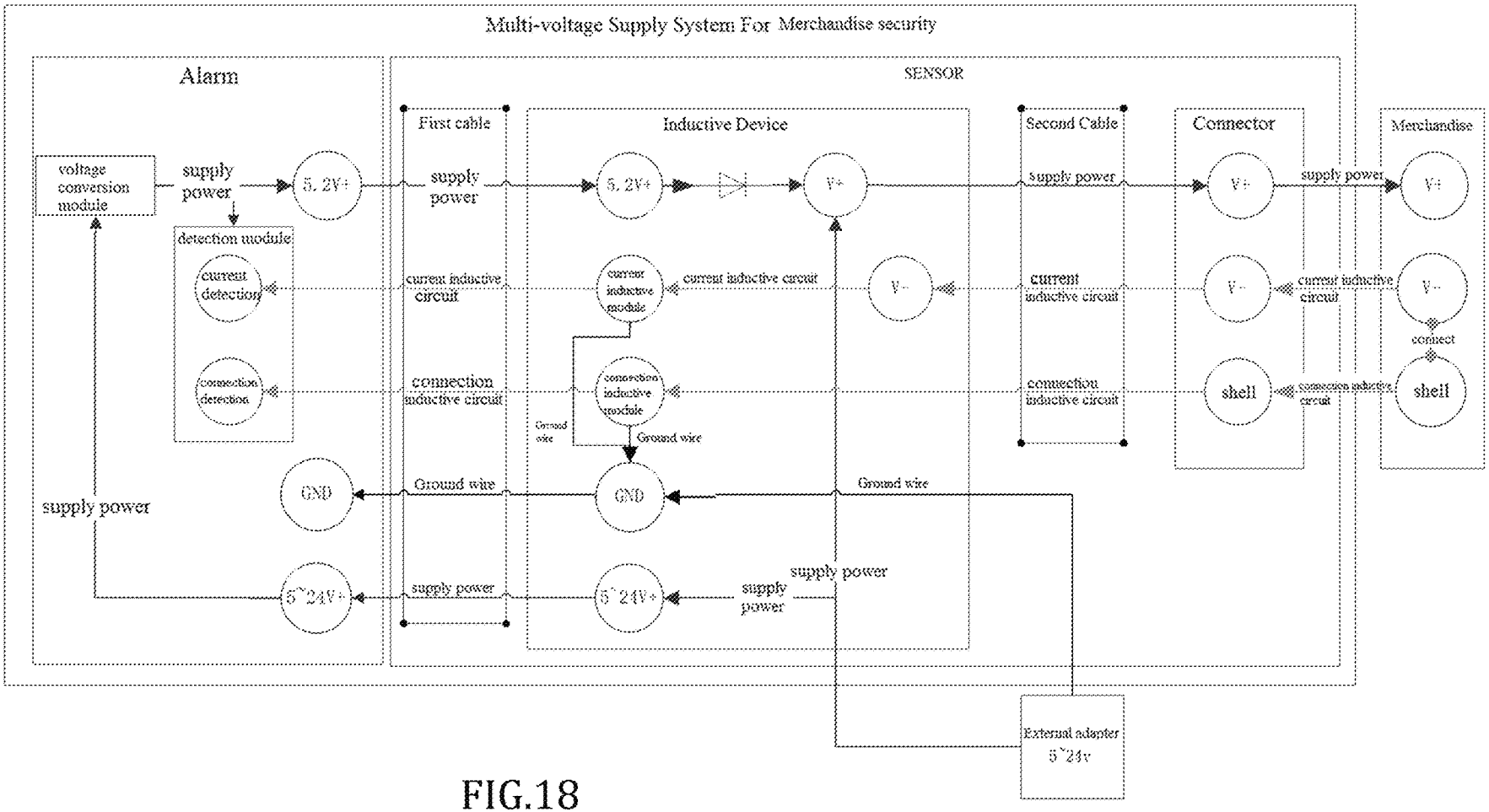
FIG. 18 is a schematic diagram of one implementation of the present invention.

FIG. 18 is a view of an exemplary embodiment of the present invention. As shown in FIG. 18, a system of the present invention includes a sensor, an alarm, and a merchandise, wherein the sensor is externally connected to an external adapter to receive power from the external adapter, and is internally connected to the merchandise and the alarm, respectively, and the sensor separately powers the connected merchandise and alarm, the power supply of the sensor can be applied to the whole system, including the alarm and the merchandise, the sensor or a device which the sensor is positioned at or connected to is equivalent to the function of shunting, dividing one accessed external voltage into at least two channels, which are supplied to the merchandise and the alarm, respectively, when the merchandise and/or the alarm has a plurality of channels, the channels can be further divided into more channels to adapt to different needs, or a plurality of the sensors or shunting devices with a shunting function can be used to satisfy the above requirements.

For the merchandise, a port that is connected from the sensor can match the merchandise, or the port that is connected from the sensor is the same as an original port of the adapter, therefore, the adapter can match the merchandise without the need to replace the adapter, thereby solving the problem that an OEM do not match other electrical equipment, which is equivalent to using any OEM adapter to power the sensor, the merchandise and the alarm at the same time.

For the alarm, since a voltage conversion module (a voltage conversion circuit) is provided inside the alarm, various different voltages connected to the alarm device can be converted into an internal operating voltage of the alarm, and therefore, the alarm can use the voltage supplied by the sensor to operate without the need for the powering by the external adapter. Moreover, in some preferred modes, if there is a multiplex condition, one alarm can also allow the inputs by a plurality of the voltages, and the voltage of a plurality of inputs can be connected to the alarm in parallel, and the voltage conversion module in the alarm can convert a plurality of the voltages into the internal operating voltage for the alarm, which is input to the internal of the alarm to realize the power supply of the multi-voltage.

Figure 19:
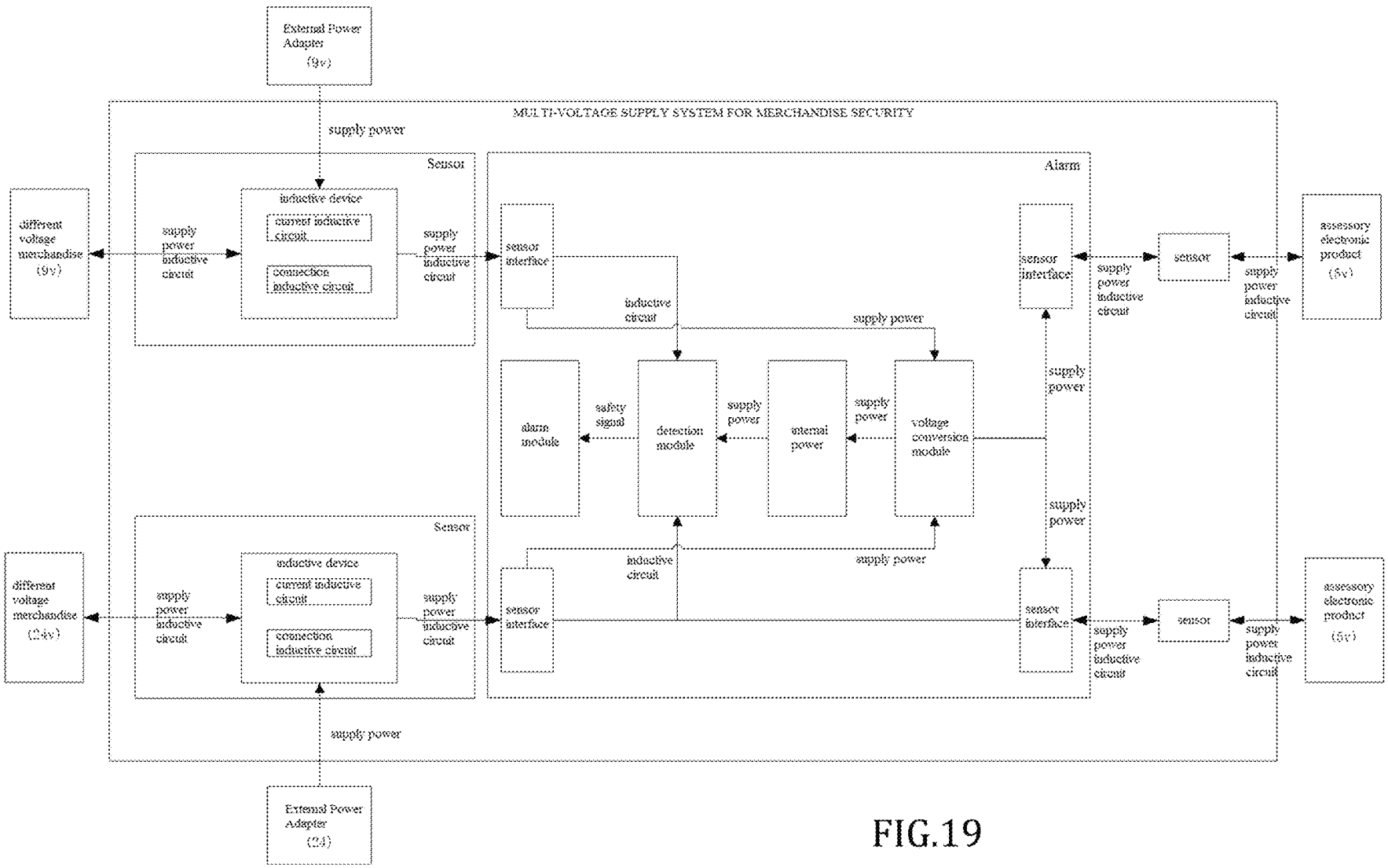
FIG. 19 is a schematic diagram of another implementation of the present invention.

FIG. 19 is a view of an exemplary embodiment of the present invention. As shown in FIG. 19, the system of the present invention includes the sensor, the merchandise, and the alarm, a plurality of the merchandise is connected to a power supply system via the sensor, respectively, and the alarm can receive power from a plurality of the sensors.

Specifically, the sensor of the present invention may include one inductive device, and the inductive device may adopt a structure as shown in FIG. 1, for example, the inductive device may include a current inductive circuit, a connection inductive circuit, and a power transmission module, wherein the power transmission module is configured to receive an external power source, such as the power provided by the adapter, in some preferred solutions, the inductive device can store a portion of the external power to power itself or other components connected thereto, such as the alarm or the merchandise, in some preferred solutions, the inductive device is only used as one power shunting device, and a shunting module can be provided in the inductive device, and the electric power input thereto is divided into at least two channels, which are supplied to the alarm and the merchandise, respectively, and in some preferred manners, when there are other powered devices, a shunt output terminal can also be added, which can be divided into three or more channels. In the present embodiment, preferably, the inductive device functions as one shunting device to separately transmit power supplied from the external power source to the alarm and the merchandise to supply power to the latter two. A sensor for merchandise security and for connecting an external power adapter includes:

The present invention also includes a first cable that is directly or indirectly connected with the inductive device and the alarm and a second cable that is directly or indirectly connected with the inductive device and the merchandise.

The first cable is configured to provide a connection between the inductive device and other devices such as the alarm, one end of the first cable is connected to the inductive device, and the other end thereof is connected to other devices, thereby providing a medium for power transmission of the two devices; the connection between the cable and the inductive device may be directly and fixedly connected, or may be indirectly connected via an adapter or the connector, which may be always fixed or detachable, generally speaking, the first cable is connected to an input terminal of the external device and to an output terminal of the inductive device.

The second cable is configured to provide a connection between the inductive device and the merchandise, one end of the second cable is connected to the inductive device, and the other end is connected to the merchandise, thereby providing the medium for the power transmission of the two devices; the connection between the second cable and the inductive device may be directly and fixedly connected, or may be indirectly connected via the adapter or the connector, which may be always fixed or detachable, generally speaking, the second cable is connected to the output terminal of the inductive device and to the input terminal of the merchandise, in some preferred solutions, the second cable is connected to and powers the merchandise via the charging interface.

The inductive device includes an inductive circuit configured to sense a charged state and/or a connection state of the merchandise. The charged state here refers to a state in which the merchandise is connected to and powered by the second cable, and if the merchandise is in the charged state, the merchandise is considered to be safe, if the merchandise is in a non-charged state, the charging interface may be pulled out, or it may be that the cable being charged is cut off, in either case, the merchandise may be considered to be in the unsafe state, in particular, if the charging interface of the merchandise is not authorized to be disconnected, then the merchandise may be considered as being possible stolen or in danger of being stolen. The connection state here refers to the physical connection state of the merchandise via the second cable, and the connection state is an security measures for the merchandise from the purely structured form, if the second cable is always connected to the merchandise in a structure, so the merchandise does not leave the second cable, the merchandise is considered to be safe, if the connection between the merchandise and the second cable is disconnected, for example, the second cable is pulled out of the merchandise, the merchandise may be considered to be the unsafe state, in particular, if the second cable is unauthorizedly removed, it is considered that the merchandise may be possibly stolen or in danger of being stolen.

The sensor is configured to send a safety signal when the merchandise is unauthorizedly removed and/or a sensor cable is cut and/or the power adapter is powered off, the safety signal refers to a signal that the merchandise is in the safe or unsafe state, the safety signal is configured to be sent to an alarm device and indicates that the alarm device is alerted, and the safety signal may come from the foregoing case that the cable is cut off or the power is off, or from the foregoing case that the merchandise is removed from a clamping device or leaves the clamping device, or from the foregoing case that the charging interface is pulled out or the charged state is suspended, the above cases may indicate that the merchandise is in the unsafe state, then, the sensor generates the safety signal correspondingly. In the field of the merchandise security, the sensor is a conventional technical means as one component of generating the safety signal, so the generation of the safety signal is a basic function of the sensor, and the improvement made by the present invention is not in the sensor itself.

Further, the inductive circuit includes a current inductive circuit and a connection inductive circuit, the inductive circuit functions as sensing whether a corresponding signal or a connection exists, the inductive circuit can be integrated in the inductive device to sense a current and the on/off of a physical connection. The current inductive circuit here can correspondingly sense whether there is power transmission from the inductive device to the merchandise in the second cable, for example, is there the current flowing from the inductive device to the merchandise? If yes, the merchandise is considered to be in the charged state, if no, the merchandise is considered to be in a state of disconnected charging, at this time, the merchandise may be unsafe. The connection inductive circuit here may correspondingly sense the structural connection relationship between the second cable and the merchandise, and for example, sense whether the structural connection of the second cable and the merchandise is present or undamaged.

The inductive device also includes the connector configured to be connected directly or indirectly to the merchandise and to provide power to the merchandise. The connector can perform the above-described function of connecting the merchandise, in some preferred solutions, the connector can be a physical form of the interface, in some preferred solutions, the connector can be the charging interface with a plug-in function. The connector can serve as a connection medium for the second cable and the merchandise, in some preferred solutions, the connector is arranged at one end of the second cable for physical and electrical connection with the merchandise and is able to power the merchandise. Similarly, in some preferred solutions, the connector can be connected directly to the merchandise, and in other preferred solutions, the connector can be indirectly connected to the merchandise via the transfer interface or other means. Of course, the connector can also be configured to connect the inductive device to the alarm, and the connector can be connected to and to power the alarm.

Figure 15:
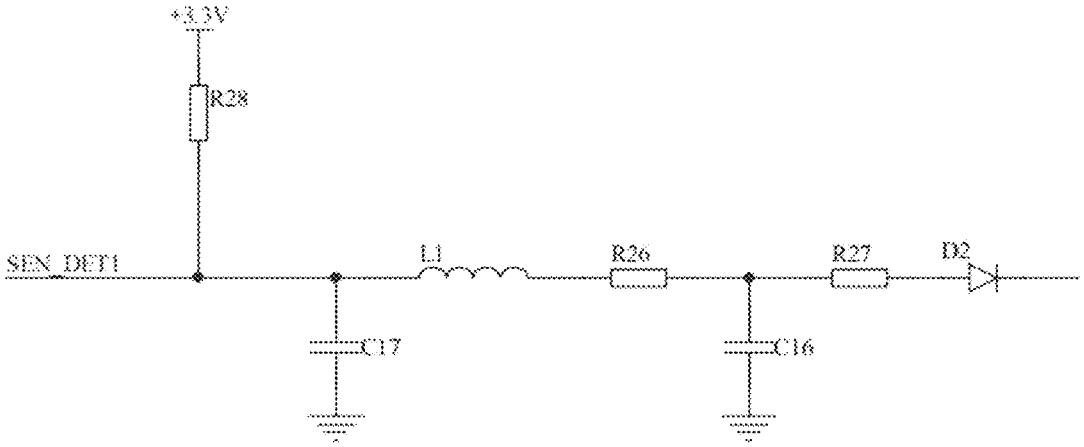
FIG. 15 is a schematic diagram of a connection inductive circuit in an inductive device of the present invention.

The connection inductive circuit is configured to sense whether the connector is connected to the merchandise. As described above, the connection inductive circuit senses the structural connection relationship between the second cable and the merchandise, when the second cable is connected to the merchandise via the connector, the connection inductive circuit is configured to sense whether the connection of the connector and the merchandise is undamaged, as shown in FIG. 15, a typical connection inductive circuit can be used in the present invention to realize the connection sensing effect.

Figure 14:
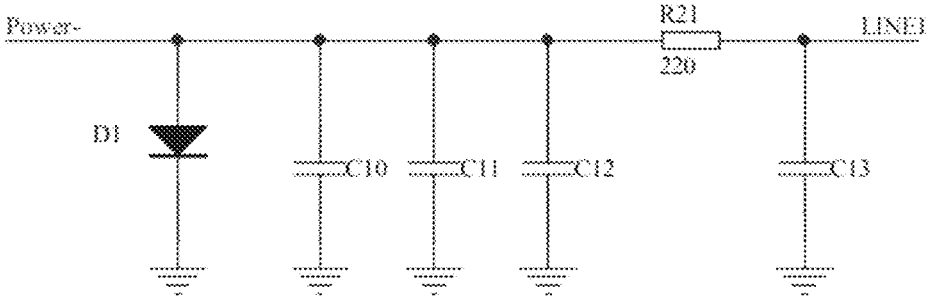
FIG. 14 is a schematic diagram of a current inductive circuit in an inductive device of the present invention.

The current inductive circuit is configured to sense whether the current between the merchandise and the power adapter is present. In some preferred solutions, the current inductive circuit is configured to sense whether the merchandise has the power input thereto, the input power can be transmitted by the inductive device via the second cable, or can be transmitted by the power adapter via the inductive device and the second cable, or is transmitted by the power adapter via the second cable, or is directly transmitted by the power adapter, and in some preferred solutions, an inductive object of the current inductive circuit may be whether the merchandise is in the charged state, or whether there is the current input to the merchandise, and no matter where the current comes from, in other preferred solutions, if the second cable is configured to supply power to the merchandise, the current inductive circuit can be configured in the second cable to sense the on/off of the current between the second cable and the merchandise, in other preferred solutions, the current inductive circuit can be arranged in the inductive device for sensing whether the merchandise is in the charged state, as shown in FIG. 14, a typical current inductive circuit can be used in the present invention to achieve current sensing.

Due to the power transmission, cables for physical connection and electrical connection are provided between the inductive device and the alarm and between the inductive device and the merchandise. In some preferred modes, the cable between the inductive device and the merchandise is connected to the current inductive circuit and the connection inductive circuit in the inductive device, respectively, so that the current inductive circuit and the connection inductive circuit can sense the electrical and physical connection between the merchandise and the inductive device, respectively, or sense whether the electrical and physical connection between the merchandise and the cable is undamaged, if yes, it indicates that the merchandise are in the safe state, at this time, the inductive device will not signal, if no, the merchandise may be in the unsafe state, at this time, the inductive device will send a safety signal. In some preferred modes, the cable between the inductive device and the alarm can be configured to have an inductive loop, and the connection inductive circuit and the current inductive circuit in the inductive device can transmit to the alarm through the inductive loop a signal whether the sensed merchandise is safe.

Figure 2:
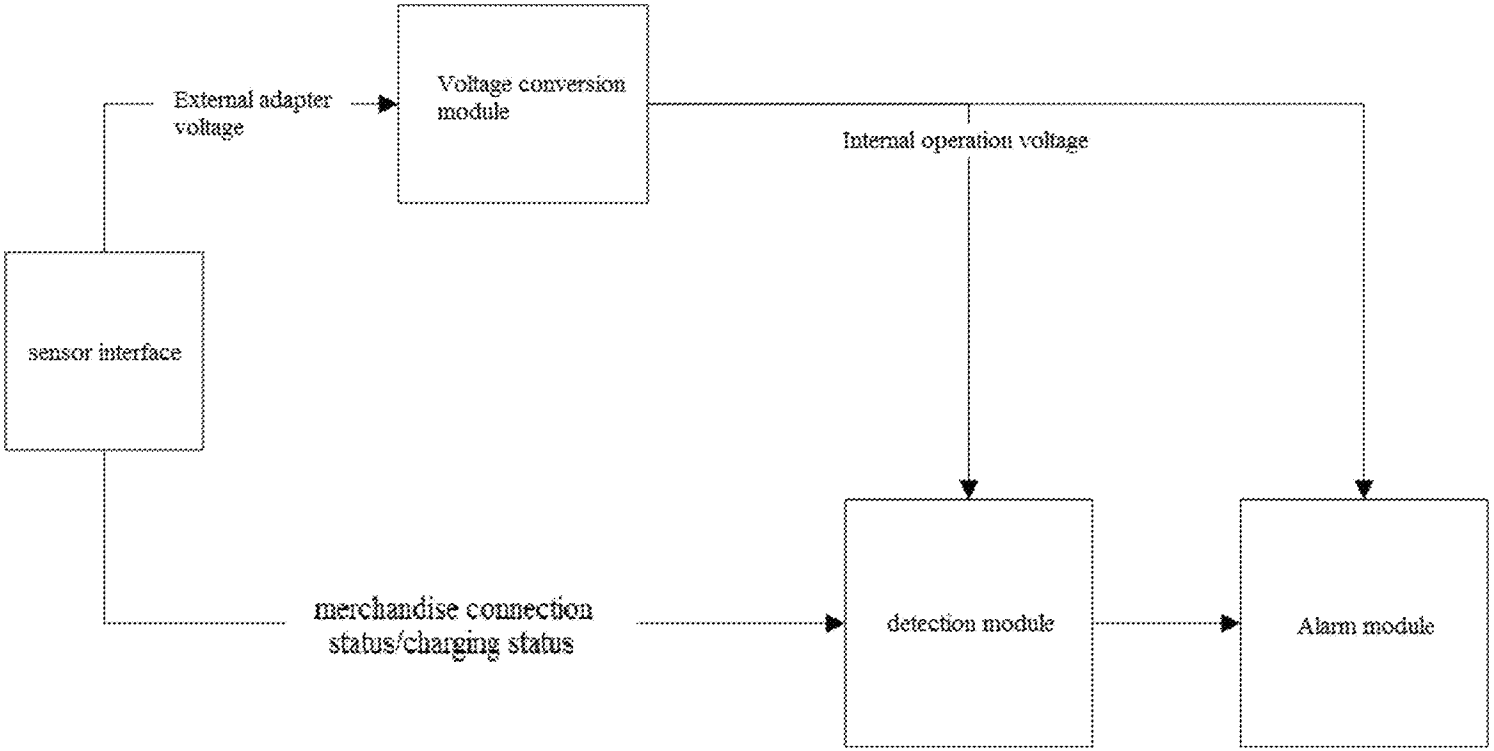
FIG. 2 is a schematic diagram of an alarm of the present invention.

The present invention also provides an alarm that cooperates with the above-mentioned sensor. FIG. 2 shows a schematic diagram of the alarm of the present invention. The alarm of the present invention has a great feature that the alarm does not need to be connected to the adapter, can directly accept the power supply of the sensor, and can accept the power supply of a plurality of the sensors at the same time, since each sensor may correspond to one merchandise, the alarm can realize the function of centralized alarm of the merchandise in a plurality of the channels, can allow simultaneous access by different OEMs or different types of the merchandise and is not affected by the access ports of the OEM or the merchandise.

As shown in FIG. 2, the alarm of the present invention includes one interface for being connected to the sensor, this interface is an input interface of the alarm, and can accept an input of the external power source, and the sensor interface is connected to the voltage conversion module, and converts the external power input received by the sensor interface into the internal operating voltage, and the internal operating voltage can be received by other modules in the alarm and powers the other modules, such as a detection module and an alarm module, wherein the detection module can also be connected to the sensor interface and receives the safety signal sent by the sensor, the detection module can be one signal detection circuit to sense whether a safety signal input is present. The alarm module can be an alarm device such as a buzzer or an LED indicator, when the detection module detects that there is a safety signal input, the alarm module starts an alarm.

In some preferred modes, the alarm can allow access of a plurality of the sensor interfaces, in this case, the plurality of the sensor interfaces can be connected in parallel to the voltage conversion module, in the case of parallel connection, the plurality of sensor interfaces can simultaneously have power input, or only one or several of the sensor interfaces have power input, the voltage conversion module converts all input power into the internal operating voltage of the alarm, once the sensor interface is connected, the voltage conversion module and the detection module can simultaneously be turned on, that is, as long as a voltage is input to the voltage conversion module, there is also a corresponding input connected to the detection module, and the sensor interface of the same circuit is connected to the detection module and is connected to the voltage conversion module in series, different sensor interfaces are connected to the detection modules in parellel in the same way that the different sensor interfaces are connected to the voltage conversion module in parellel.

Figure 16:
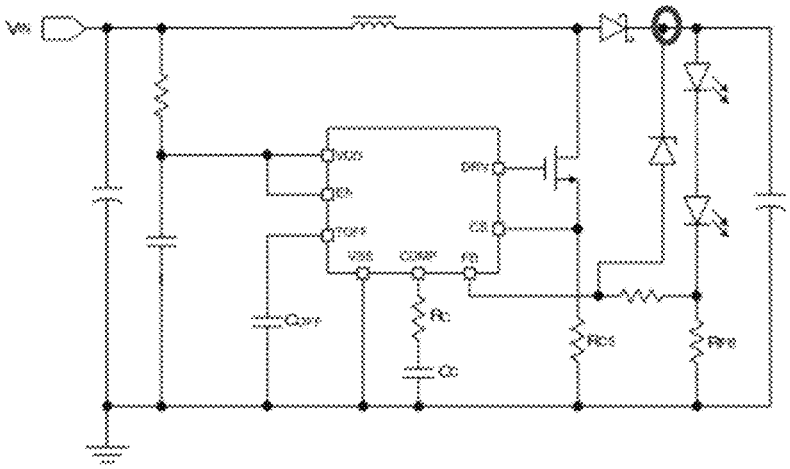
FIG. 16 is a schematic diagram of a voltage conversion circuit of the present invention.
Figure 17:
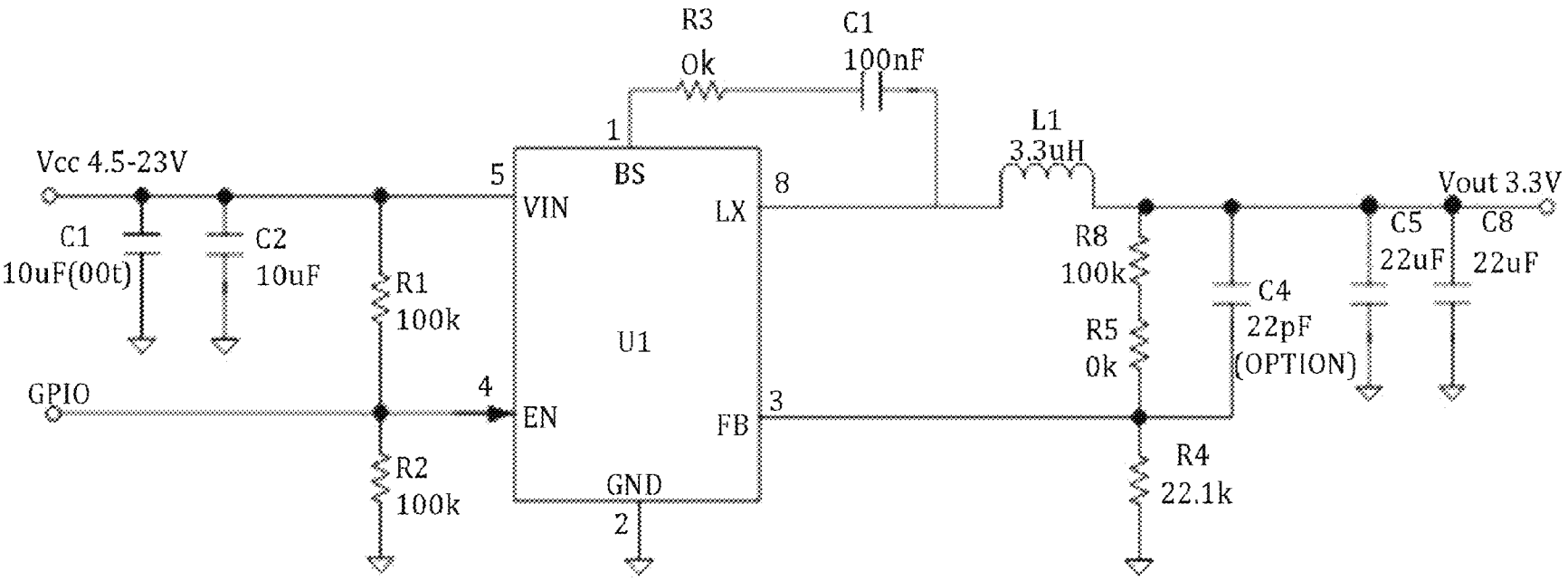
FIG. 17 is another schematic diagram of a voltage conversion circuit of the present invention.

FIGS. 16-17 are an example of a typical voltage conversion circuit diagram that can be adopted in the present invention. In FIG. 16, a circled portion is an output terminal, and the voltage input from the input terminal can be converted into a voltage range of the alarm via the conversion by a voltage conversion circuit. The voltage conversion circuit in FIG. 16-17 is able to receive the conversion from an input of 4.5-23V to a 3.3V output.

As shown in FIG. 2-13, the alarm 5 of the present invention may include one housing, and the housing accommodates the above-mentioned module and circuit. The housing in parellel is provided thereon with an interface, and the interface may be one or more, the interface can be directly and electrically connected to the voltage conversion circuit, so that the voltage input from the interface directly enters the voltage conversion circuit for conversion, and then is supplied by the voltage conversion circuit to other power modules inside the alarm.

The present invention also provides a connection device equipped to realize in the functions of the above described sensor and alarm. The function of the connection device is that in some application scenarios, the inductive device can be accommodated to connect an external power adapter, a merchandise, and an alarm. The connection device can be used as one current distribution hardware device to shunt the current of the external power adapter and to supply the current to the merchandise and the alarm, respectively.

Figure 3:
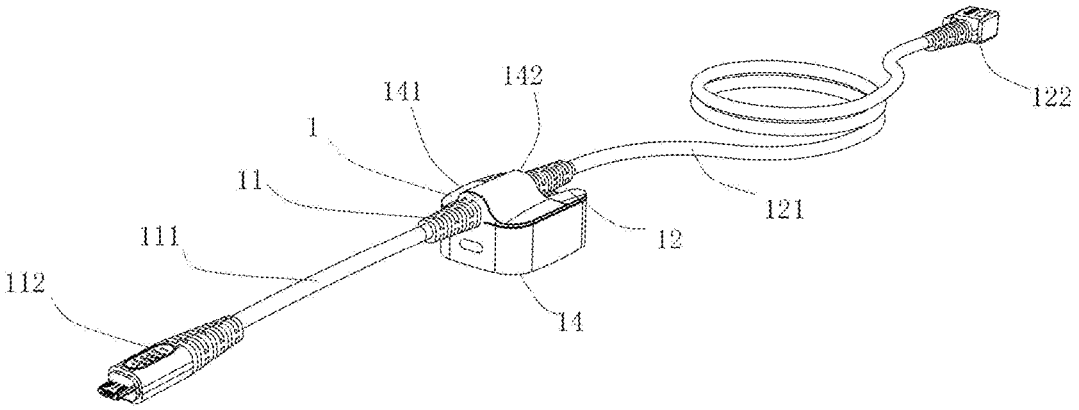
FIG. 3 is a diagram of one implementation of a connection device of the present invention.

FIG. 3 is a view of one implementation of a connection device of the present invention, as can be seen from FIG. 3, the connection device 1 has at least two interfaces, wherein a first interface 11 is connected to a first cable 111, and the first cable 111 is provided thereon with a first connector 112 for connecting an alarm or other devices, a second interface 12 is connected to a second cable 121, and the second cable 121 is provided thereon with a second connector 122, the second connector 122 can be used for connecting the merchandise.

Figure 4:
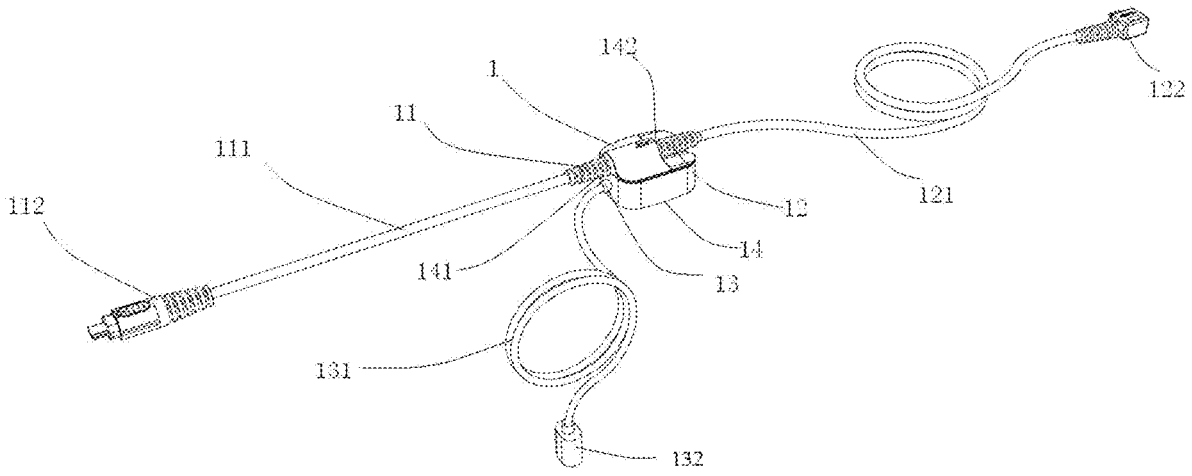
FIG. 4 is a diagram of another implementation of a connection device of the present invention.

FIG. 4 is a view of another implementation of a connection device of the present invention, as can be seen from FIG. 4, the connection device 1 has at least three interfaces, wherein the first interface 11 is connected to the first cable 111, and the first cable 111 is provided thereon with the first connector 112 for connecting the alarm or other devices, a second interface 12 is connected to the second cable 121, and the second cable 121 is provided thereon with the second connector 122, the second connector 122 can be used for connecting the merchandise. In addition to the above two interfaces, as shown in FIG. 4, one power interface 13 is further arranged under the first interface 11, and the power interface 13 can be connected to the external power adapter 2 via a third cable 131, a hole 31 can be opened in a display table 3, so that the third cable 131 and the external power adapter 2 are placed below the display table 3, and the alarm may be arranged below the display table 3 when necessary.

Figure 5:
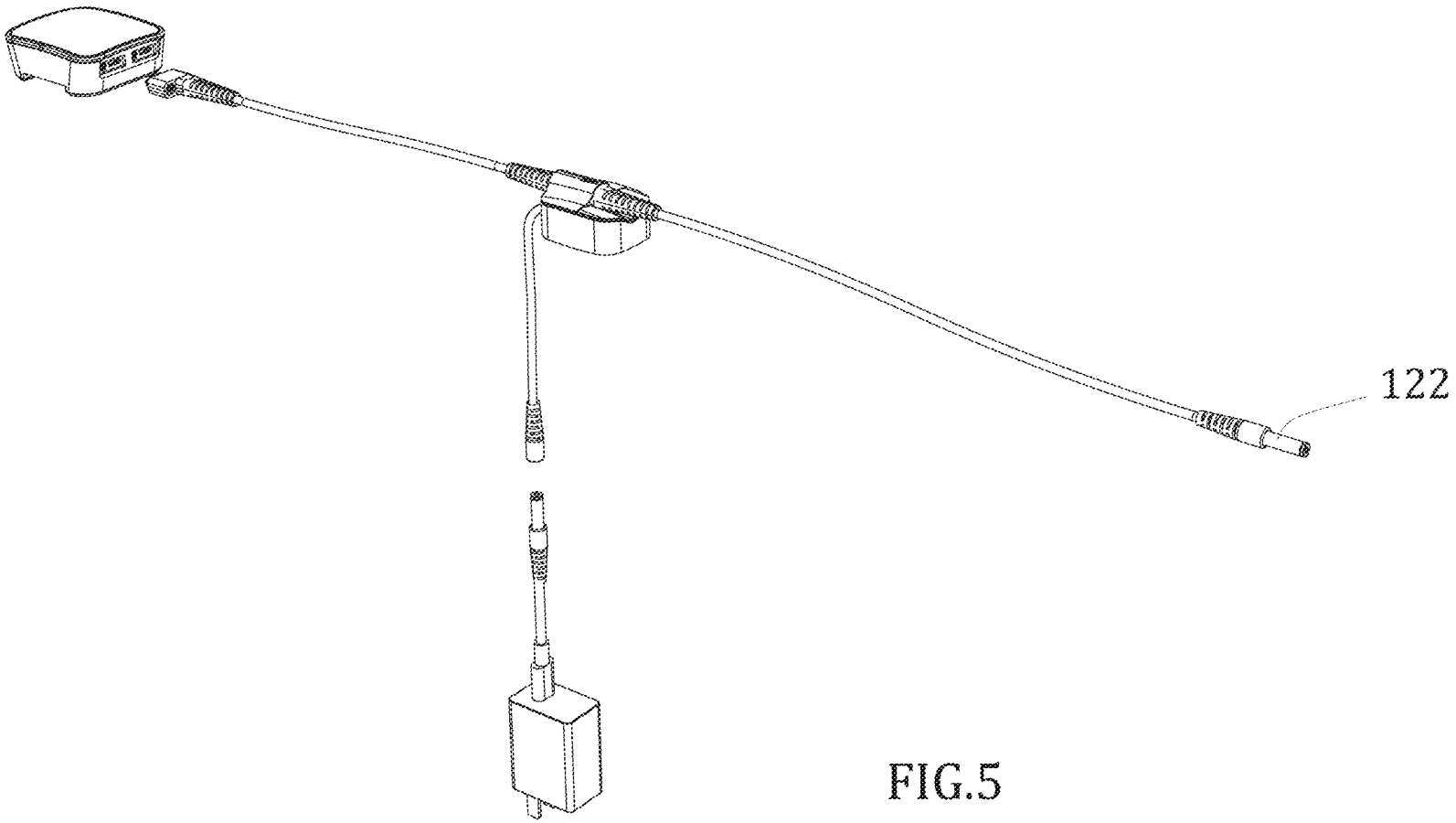
FIG. 5 is a schematic diagram of a third implementation of a connection device of the present invention.

FIG. 5 is a view of a third implementation of a connection device of the present invention. In the implementation shown in FIG. 5, the second connector 122 is a DC interface and can be used to connect certain types of notebook computers.

Figure 6:
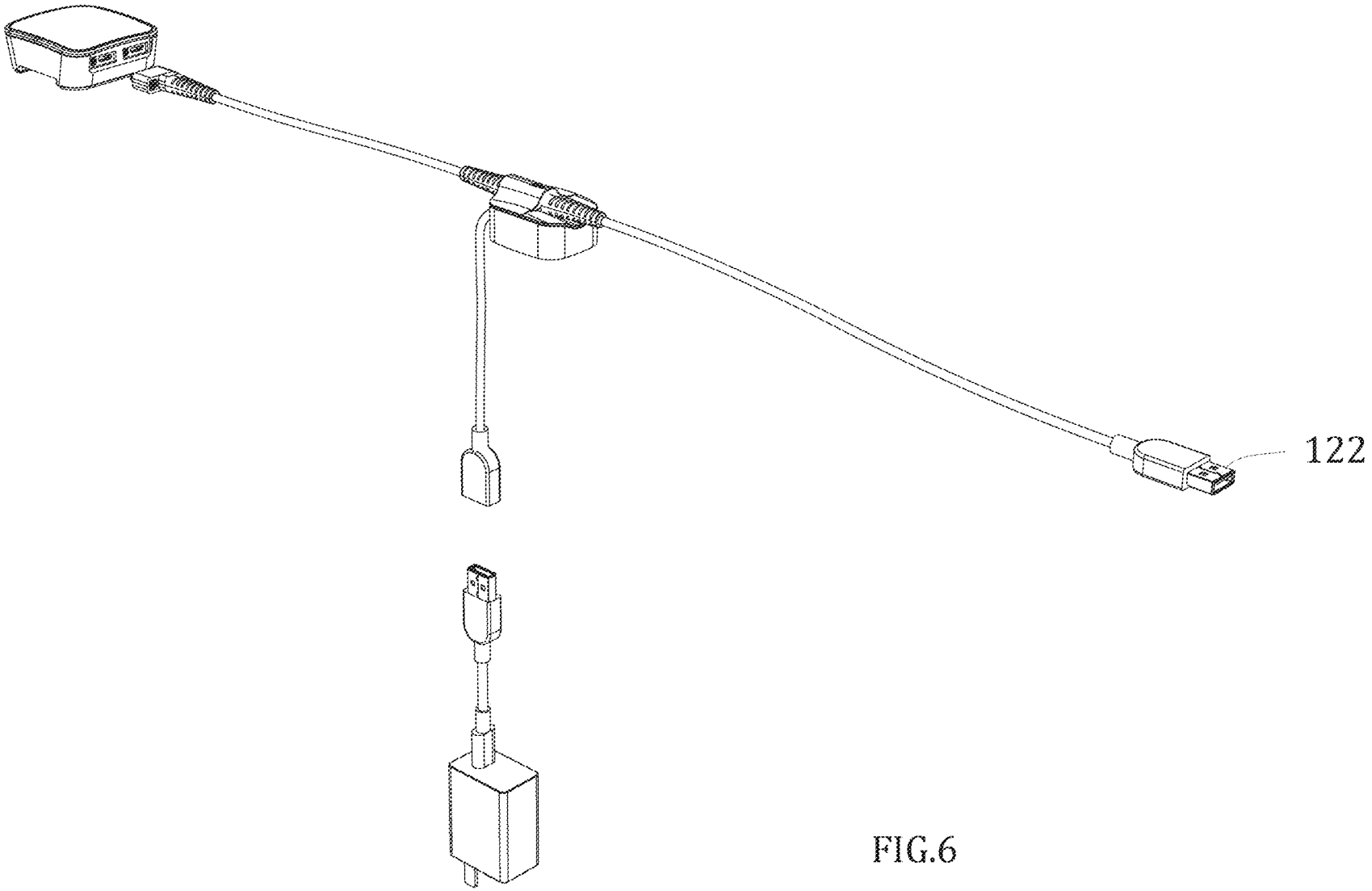
FIG. 6 is a diagram of a fourth implementation of a connection device of the present invention.

FIG. 6 is a view of a fourth implementation of the present invention. In the implementation shown in FIG. 6, the second connector 122 is a notebook square interface that can be used to connect certain types of the notebook computers.

In other implementations, the second connector 122 can also be a USB or other type of charged interface.

Figure 7:
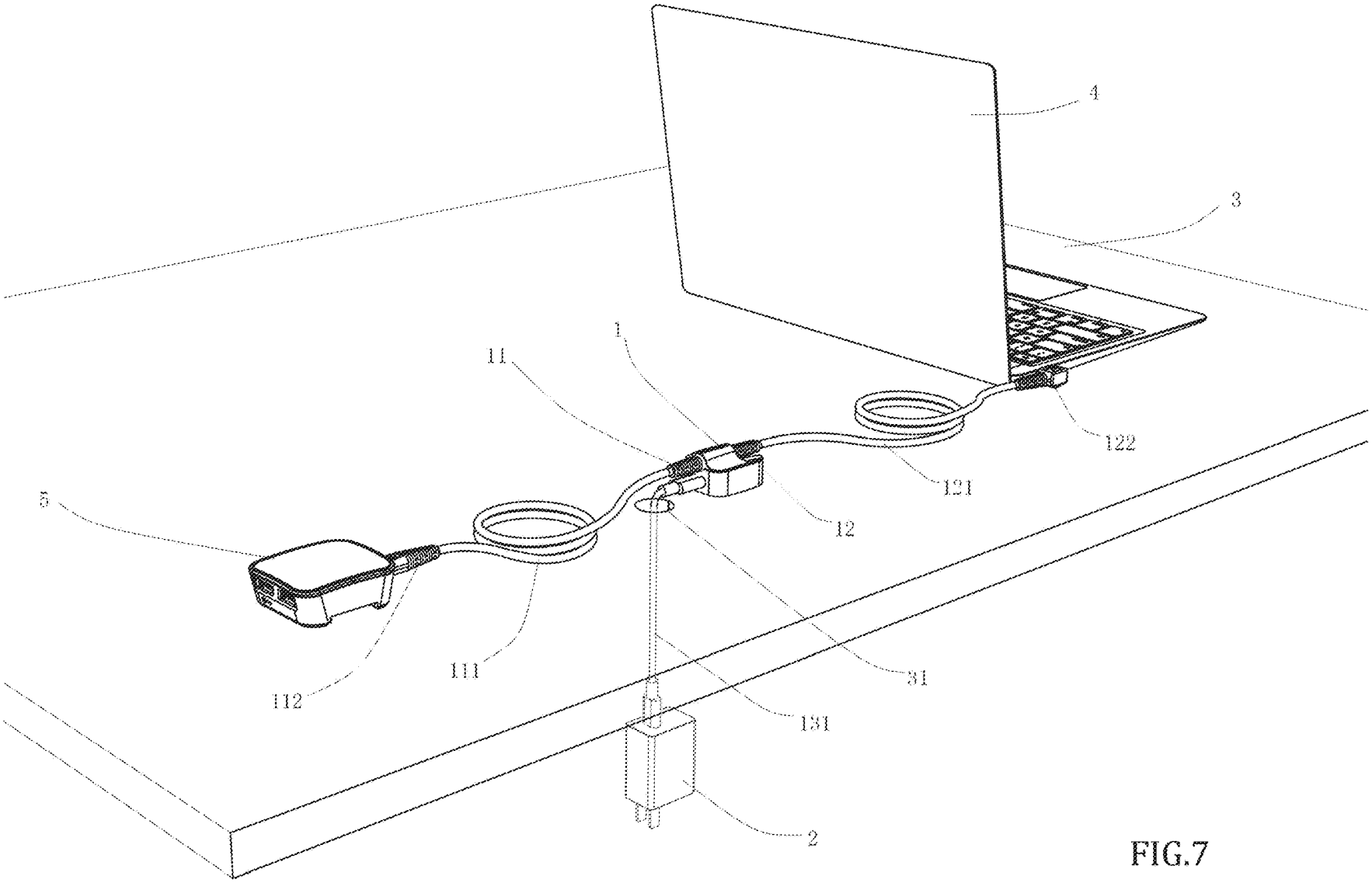
FIG. 7 is a view of an application scenario of a connection device of the present invention on a merchandise.

FIG. 7 is a view of an application scenario of a connection device of the present invention on the merchandise. As shown in FIG. 7, the inductive device 1 of the present invention can be attached to the surface of the display table 3 and can be fixed as needed. The merchandise 4 shown in the scenario of FIG. 7 is the notebook computer. The connection device 1 is connected to the alarm 5 via the first cable 111, the inductive device 1 is connected to the notebook computer via the second cable 121, the connection device 1 is also connected to the power adapter 2 thereon, and the power adapter 2 is connected to the connection device via the power interface 13 under the first interface 11, and the power interface 13 can extend into the connection device, and the current input by the power adapter 2 is divided into two paths via one shunting circuit to supply the current to the alarm and the merchandise, respectively, so that the present invention can supplies power to both the alarm and the merchandise via the connection device 1.

Figure 8:
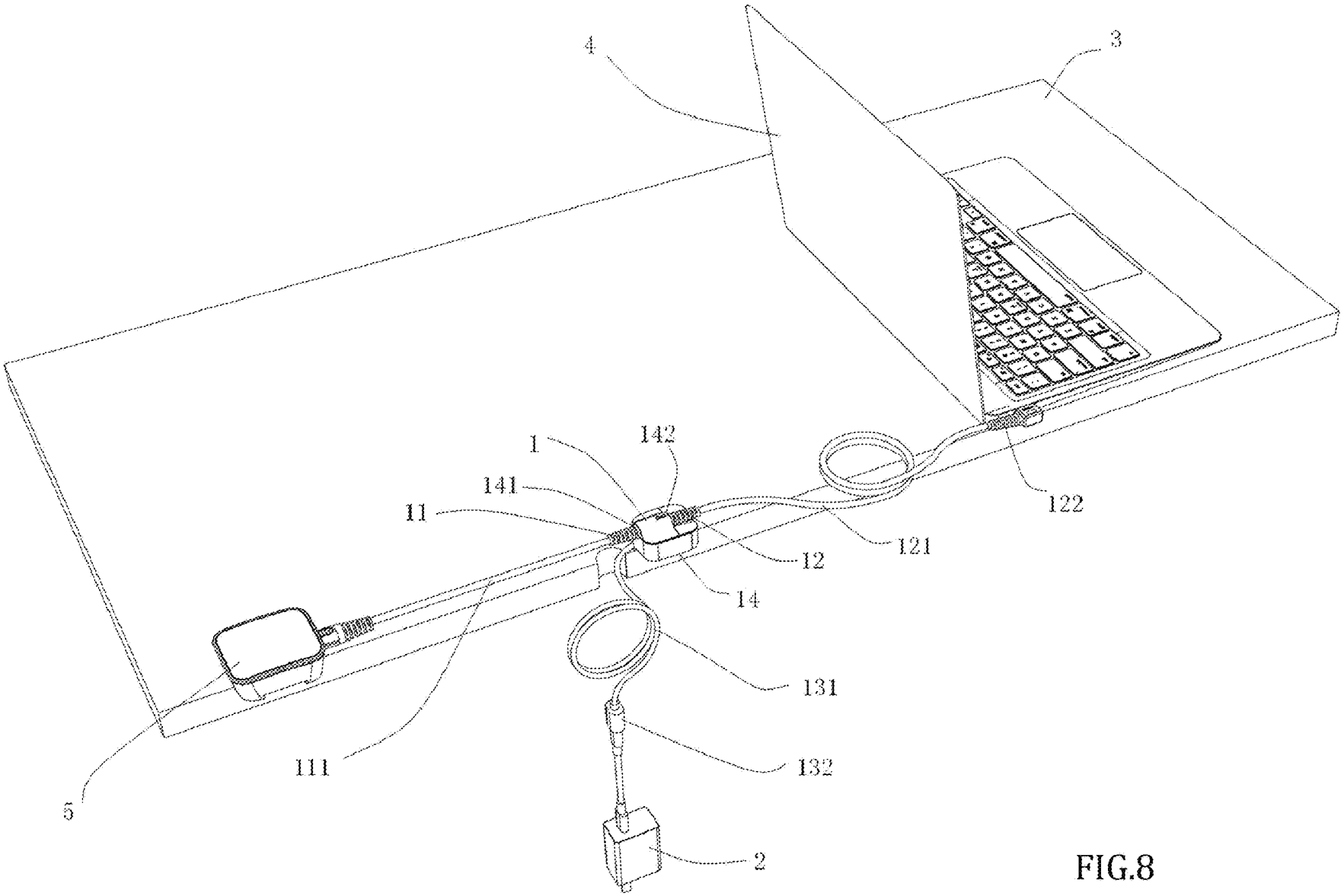
FIG. 8 is a view of another application scenario of a connection device of the present invention on a merchandise.

FIG. 8 is a view of another application scenario of a connection device of the present invention on a merchandise. As shown in FIG. 8, the inductive device 1 of the present invention can be attached to the surface of the display table 3 and can be fixed as needed. The merchandise 4 shown in the scenario of FIG. 8 is the notebook computer. The connection device 1 is connected to the alarm 5 via the first cable 111, the inductive device 1 is connected to the notebook computer via the second cable 121, the connection device 1 is also connected to the power adapter 2 thereon, and the power adapter 2 is connected to the connection device via the power interface 13 under the first interface 11, and the power interface 13 can extend into the connection device, and the current input by the power adapter 2 is divided into two paths via the shunting circuit to supply the current to the alarm and the merchandise, respectively, so that the present invention can simultaneously supplies power to the alarm device and the merchandise via the connection device 1, in the scenario shown in FIG. 8, the power interface 13 is connected to the power adapter 2 via an intermediate transfer interface 132 arranged on the third cable 131. The intermediate transfer interface 132 makes the present invention be applied to the power adapter 2 with more interface types.

Figure 9:
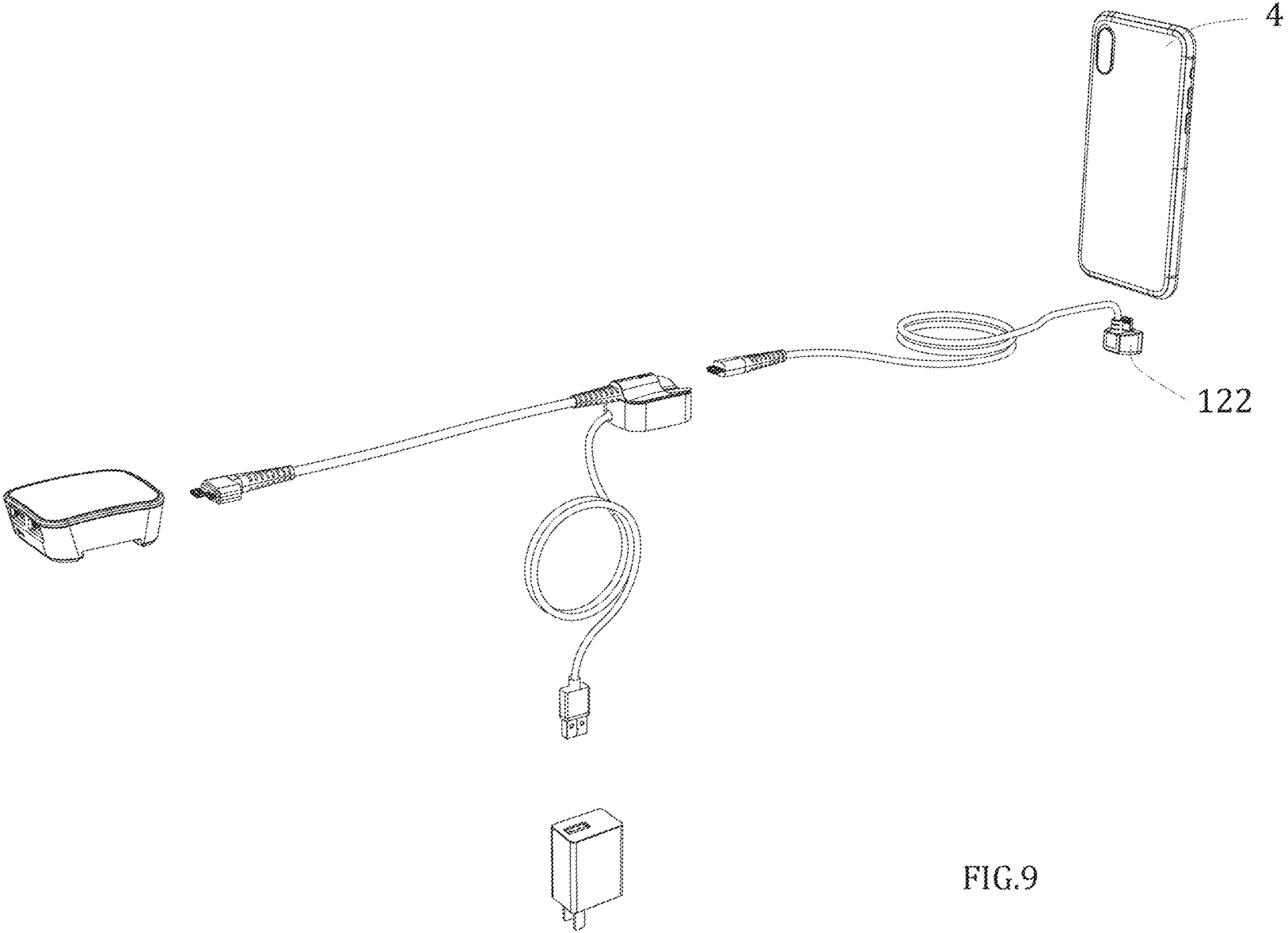
FIG. 9 is a view of an application scenario of a connection device of the present invention on another merchandise.

FIG. 9 is a view of an application scenario of a connection device of the present invention on another merchandise. The merchandise 4 shown in FIG. 9 is a mobile phone, and the corresponding second connector 122 can be a Lighting interface, a Micro interface, a Mini USB interface, or a Type C interface, these interfaces can be connected to the charging interface of the phone and power the phone.

Figure 10:
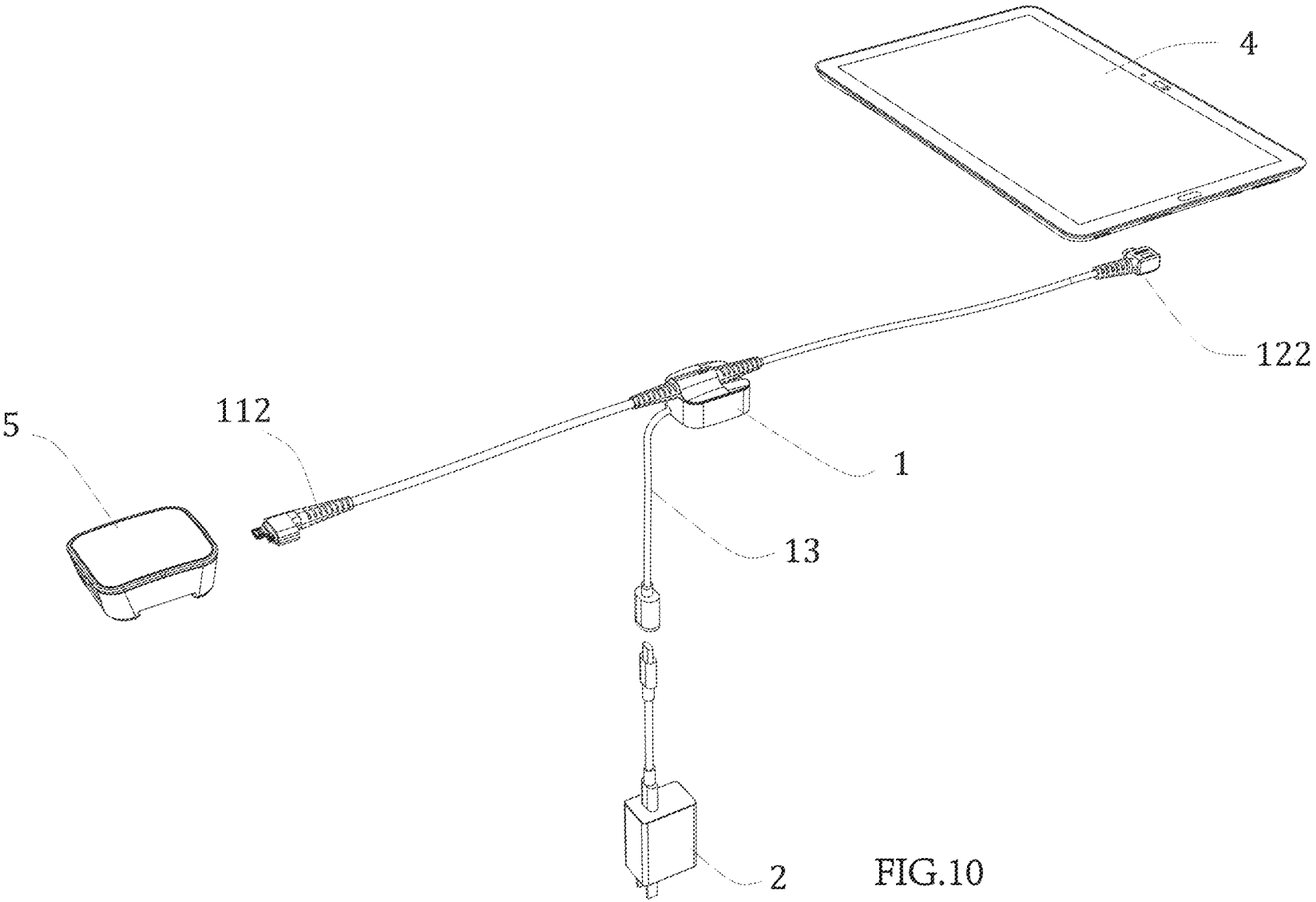
FIG. 10 is a view of an application scenario of a connection device of the present invention on a third merchandise.

FIG. 10 is a view of an application scenario on a third merchandise of the present invention. The merchandise 4 shown in FIG. 10 is a tablet computer, and the corresponding second connector 122 can be a Type C interface that can be connected to and power a charging interface of the tablet.

Figure 11:
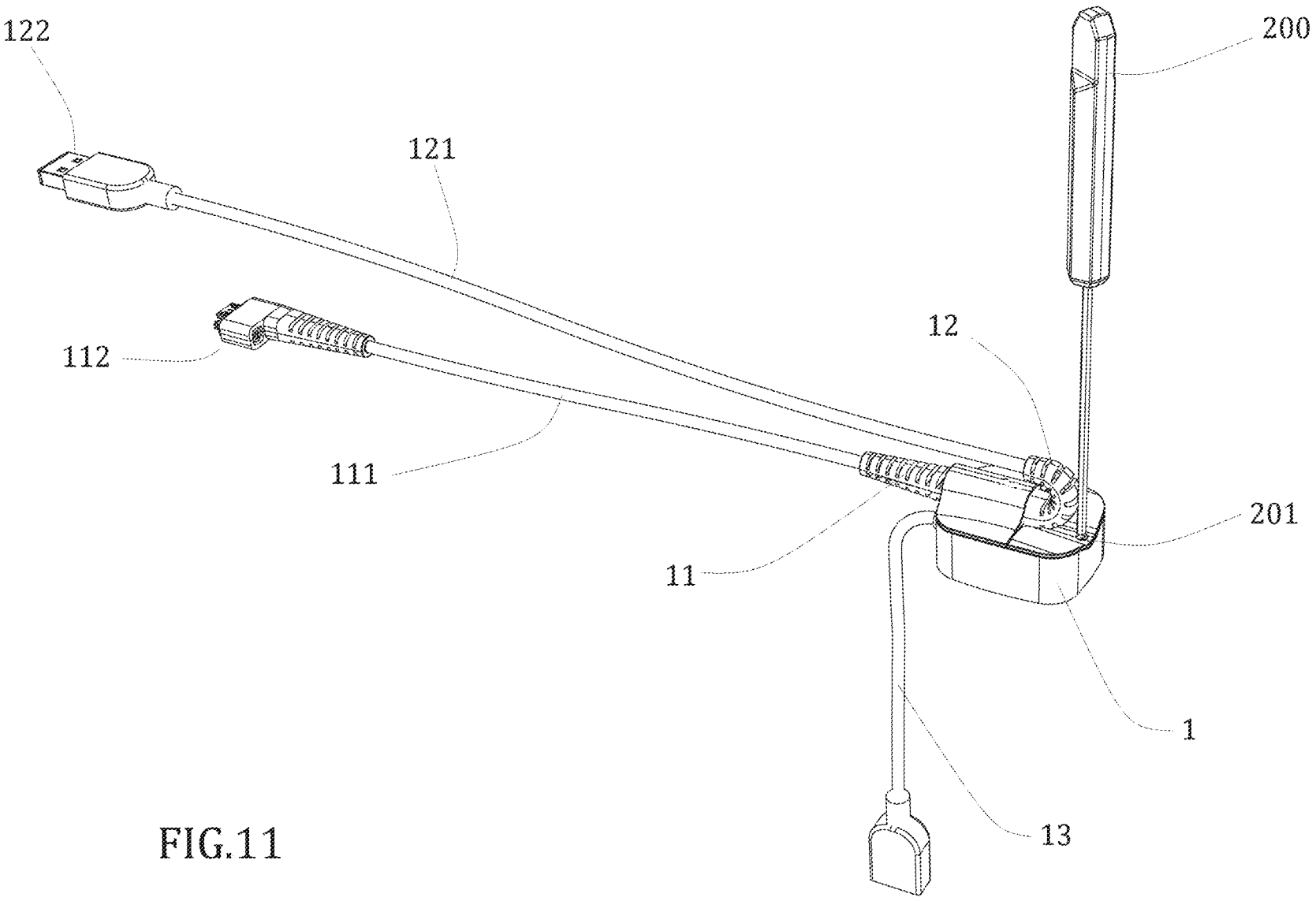
FIG. 11 is a diagram of a mounting manner of a connection device of the present invention.

FIG. 11 is a view of a mounting manner of a connection device of the invention. As shown in FIG. 11, a mounting hole 201, such as a screw hole, can be arranged on the connection device 1, in some preferred modes, the screw hole can not be exposed for aesthetic reasons, for example, the screw hole is arranged at the lower portion of a second connector 12, at the time of installation, the second connector 12 is bent to expose the mounting hole 201, and a fixing member such as a screw is screwed into the mounting hole 201 by a tool 200 to fix the connection device 1 on a support surface. In other implementations, the mounting hole 201 can also be omitted, by an attaching manner, for example, an adhesive layer is arranged on a bottom surface 14, and the bottom surface 14 may be directly attached to the support surface.

Figure 12:
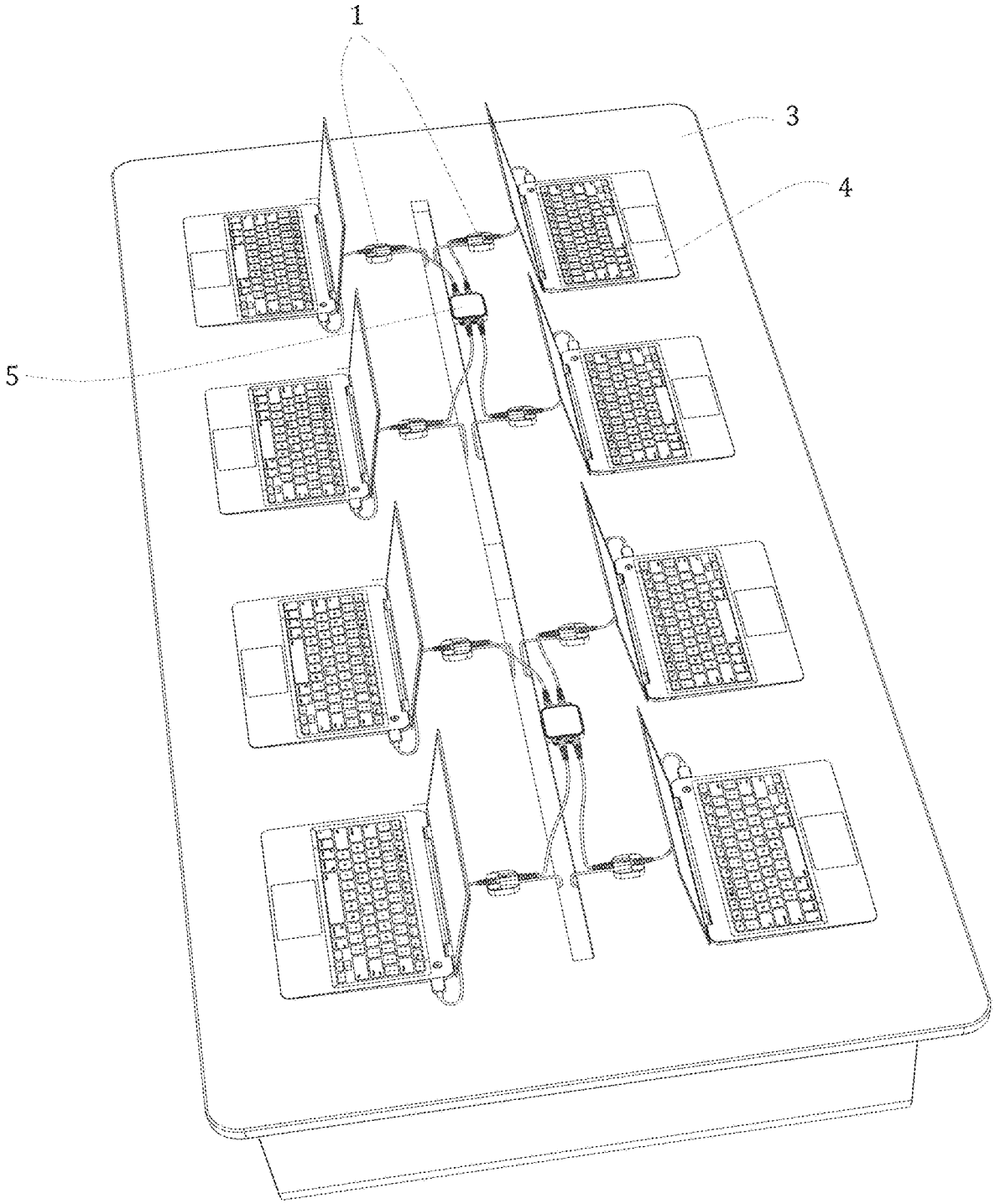
FIG. 12 is a view of an application scenario of a connection device of the present invention in a multi-merchandise environment.

FIG. 12 is an implementation of a connection device of the present invention in a multi-merchandise environment. In the scenario shown in FIG. 12, there are a number of similar merchandise 4 (laptops), which may be located in the same exhibition area, or in other solutions, in different exhibition areas/stands. In the scenario shown in FIG. 12, one alarm 5 can allow access of a plurality of the first connectors 112 and receive power by the first connector 112, and each first connector 112 can correspond to one connection device 1, each connection device 1 is also possible to correspond to an electrical merchandise, and the connection device 1 can also supply power to the electrical merchandise via the adapter.

Figure 13:
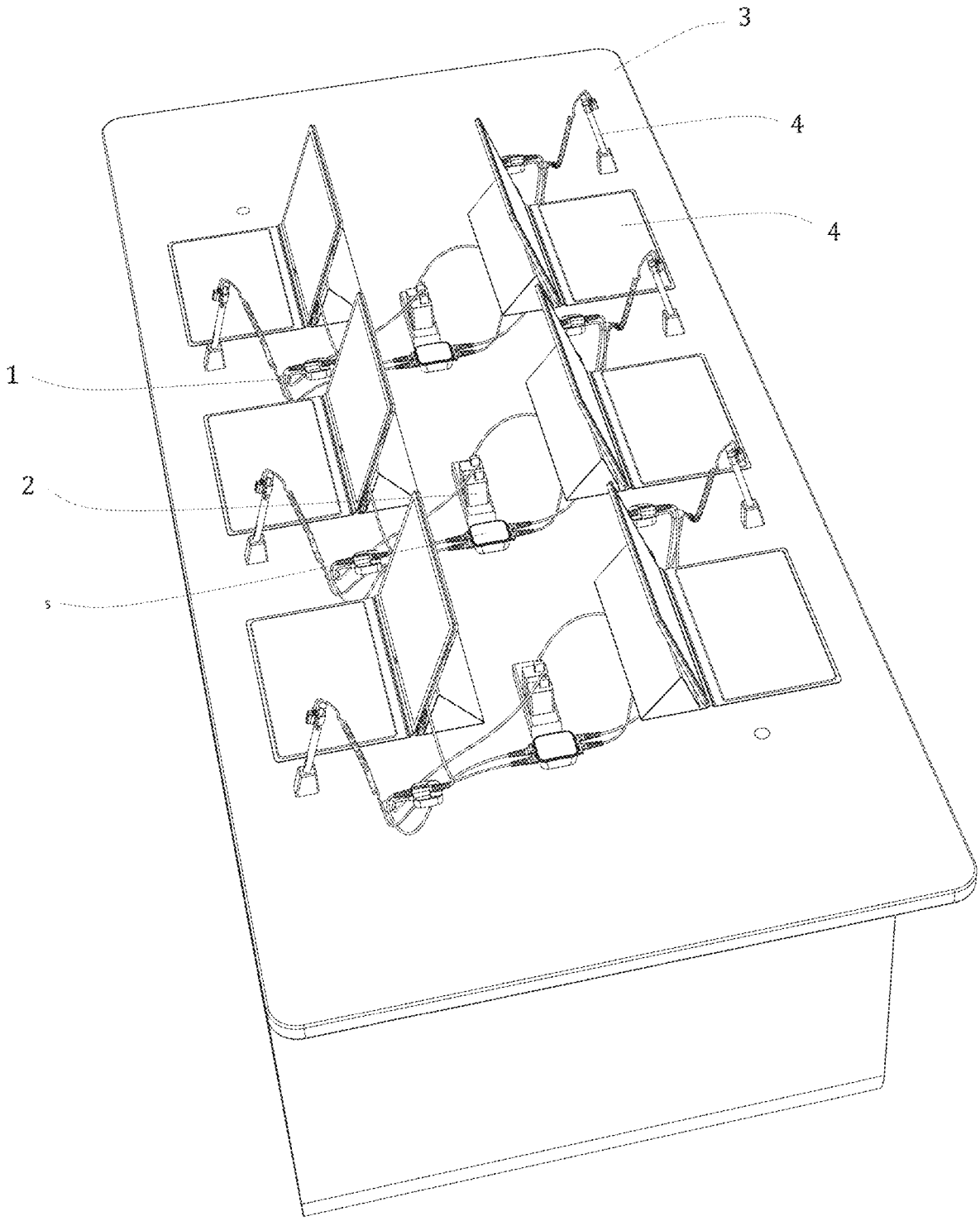
FIG. 13 is a view of another application scenario of a connection device of the present invention in a multi-merchandise environment.

FIG. 13 is another implementation of a connection device of the present invention in a multi-merchandise environment. In the scenario shown in FIG. 13, there are a number of different categories of merchandise 4 (laptops and electronic touch pens) which may be located in the same exhibition area, and in other solutions, in different exhibition areas/stands. In the scenario shown in FIG. 13, one alarm 5 can allow access of a plurality of the first connectors 112 and receive power by the first connector 112, and each first connector 112 can correspond to one connection device 1, each connection device 1 can correspond to one electrical appliance, the connection device 1 can also supply power for the electric appliance via the adapter, in the environment of different types of merchandise, there can be a plurality of different adapters, and the power is supplied through the connection device, the alarm can receive power from a plurality of different adapters, and the power supply of different adapters can be converted by the alarm into the internal operating voltage that can be used by itself.

What is claimed is:

1. A multi-voltage power supply system for merchandise security, comprising:

a sensor configured to be connected to a plurality of merchandise, respectively, and to be able to sense whether the merchandise to which the sensor is connected is in a safe state, and to send a safety signal when the connected merchandise is unauthorizedly removed and/or a sensor connection is disconnected and/or a power adapter is powered off;

an alarm comprising at least one interface for connecting the sensor, the alarm being configured to be able to receive power supply of and a safety signal of the sensor; wherein the sensor is configured to be connected to a power adapter through a power interface and to power the connected merchandise and/or the connected alarm;

the alarm is configured to be able to supply power without an external power source;

the alarm is configured to have a voltage conversion module for converting a various external voltage to an internal voltage suitable for the alarm;

wherein the sensor comprises an inductive device, the inductive device can be directly or indirectly connected to a power interface for being connected to the power adapter, and is configured to be able to provide power to the merchandise and/or the alarm;

the inductive device comprises a first cable and a second cable, the first cable is directly or indirectly connected to the inductive device and the alarm, and the second cable is directly or indirectly connected to the inductive device and the merchandise;

the inductive device comprises an inductive circuit configured to sense a charged state and/or a connection state of the merchandise.

2. The multi-voltage power supply system for the merchandise security according to claim 1, wherein the sensor comprises a plurality of sensors, the alarm comprises a plurality of interfaces, and the plurality of interfaces can cooperate with the plurality of sensors to realize a plurality of different voltage inputs.

3. The multi-voltage power supply system for the merchandise security according to claim 2, wherein the plurality of interfaces are connected to a voltage conversion circuit, respectively.

4. The multi-voltage power supply system for the merchandise security according to claim 1, wherein the inductive circuit comprises a current inductive circuit and a connection inductive circuit.

5. The multi-voltage power supply system for the merchandise security according to claim 4, wherein the current inductive circuit is configured to sense whether the current between the merchandise and the power adapter is present.

6. The multi-voltage power supply system for the merchandise security according to claim 1, comprising a connector configured to be directly or indirectly connected to the merchandise and to be able to provide power to the merchandise.

7. The multi-voltage power supply system for the merchandise security according to claim 6, wherein the connection inductive circuit is configured to sense whether the connector is connected to the merchandise.

8. A multi-voltage power supply system for merchandise security, comprising:

a sensor configured to be connected to a plurality of merchandise, respectively, and to be able to sense whether the merchandise to which the sensor is connected is in a safe state, and to send a safety signal when the connected merchandise is unauthorizedly removed and/or a sensor connection is disconnected and/or a power adapter is powered off;

an alarm comprising at least one interface for connecting the sensor, the alarm being configured to be able to receive power supply of and a safety signal of the sensor; wherein the sensor is configured to be connected to a power adapter through a power interface and to power the connected merchandise and/or the connected alarm;

the alarm is configured to be able to supply power without an external power source;

the alarm is configured to have a voltage conversion module for converting a various external voltage to an internal voltage suitable for the alarm, wherein the system comprises one inductive device, wherein the inductive device functions as a connection between an external power adapter and the merchandise, and continuously providing the merchandise with the power from the external power adapter and is considered as one condition that the merchandise is in a safe state, once the merchandise is powered off, the inductive device is considered as being that the merchandise is in an unsafe state.

* * * * *